US007574165B2

(12) United States Patent
Mitsuoka et al.

(10) Patent No.: US 7,574,165 B2
(45) Date of Patent: Aug. 11, 2009

(54) FIXING METHOD, FIXING DEVICE, AND IMAGE FORMING APPARATUS

(75) Inventors: Tetsunori Mitsuoka, Tondabayashi (JP); Toshiaki Kagawa, Nara (JP)

(73) Assignee: Sharp Kabushiki Kaisha, Osaki-Shi (JP)

( * ) Notice: Subject to any disclaimer, the term of this patent is extended or adjusted under 35 U.S.C. 154(b) by 314 days.

(21) Appl. No.: 10/573,261

(22) PCT Filed: Sep. 24, 2004

(86) PCT No.: PCT/JP2004/013933

§ 371 (c)(1),
(2), (4) Date: Mar. 23, 2006

(87) PCT Pub. No.: WO2005/031472

PCT Pub. Date: Apr. 7, 2005

(65) Prior Publication Data

US 2007/0036594 A1 Feb. 15, 2007

(30) Foreign Application Priority Data

Sep. 26, 2003 (JP) ..... 2003-335686

(51) Int. Cl.
*G03G 15/20* (2006.01)

(52) U.S. Cl. ..... 399/327

(58) Field of Classification Search ..... 399/328, 399/327

See application file for complete search history.

(56) References Cited

U.S. PATENT DOCUMENTS 5,253,024 A * 10/1993 Okuda et al. ..... 399/324
5,287,153 A 2/1994 Senba et al.
5,331,385 A * 7/1994 Ohtsuka et al. ..... 399/331
5,778,278 A 7/1998 Jeon et al.
6,438,348 B2 * 8/2002 Kobaru et al. ..... 399/333
2001/0016132 A1 * 8/2001 Nanataki et al. ..... 399/330

(Continued)

FOREIGN PATENT DOCUMENTS

JP 5-88575 A 4/1993

(Continued)

*Primary Examiner*—David M Gray
*Assistant Examiner*—Andrew V Do
(74) *Attorney, Agent, or Firm*—Birch, Stewart, Kolasch & Birch, LLP

(57) ABSTRACT

A fixing device (14) includes a fixing roller (31) which is in contact with an unfixed image formed on a printing medium (91) with toner (93) and a pressure roller (32) which is in contact with the fixing roller (31). The fixing device (14) causes the fixing roller (31) and the pressure roller (32) to sandwich and feed the printing medium (91), so as to fix the unfixed image onto the printing medium (91). The fixing device (14) gives a holding electric field which is an electric field in a direction for holding a reverse polarity toner (92) on the printing medium (91). The reverse polarity toner (92) has a polarity opposite to that of the toner (93) which forms an image on the printing medium. Thus, it is possible to avoid a troulile caused by the adhesion of the reverse polarity toner (92) to the pressure roller (32). Therefore, it is possible to avoid an image failure caused by the reverse polarity toner, maintain a normal image forming operation, and secure a satisfactory image quality and the life of each means even in long-term use.

1 Claim, 11 Drawing Sheets

U.S. PATENT DOCUMENTS

2002/0186981 A1* 12/2002 Takeuchi ..... 399/69
2004/0190929 A1* 9/2004 Yoshiki ..... 399/103

FOREIGN PATENT DOCUMENTS

JP 5-188815 A 7/1993
JP 6-124050 A 5/1994
JP 8-305021 A 11/1996
JP 8-305201 A 11/1996
JP 11-15316 A 1/1999
JP 11-212383 A 8/1999
JP 2003-15468 1/2003
JP 2003-263050 A 9/2003

* cited by examiner

FIG. 6

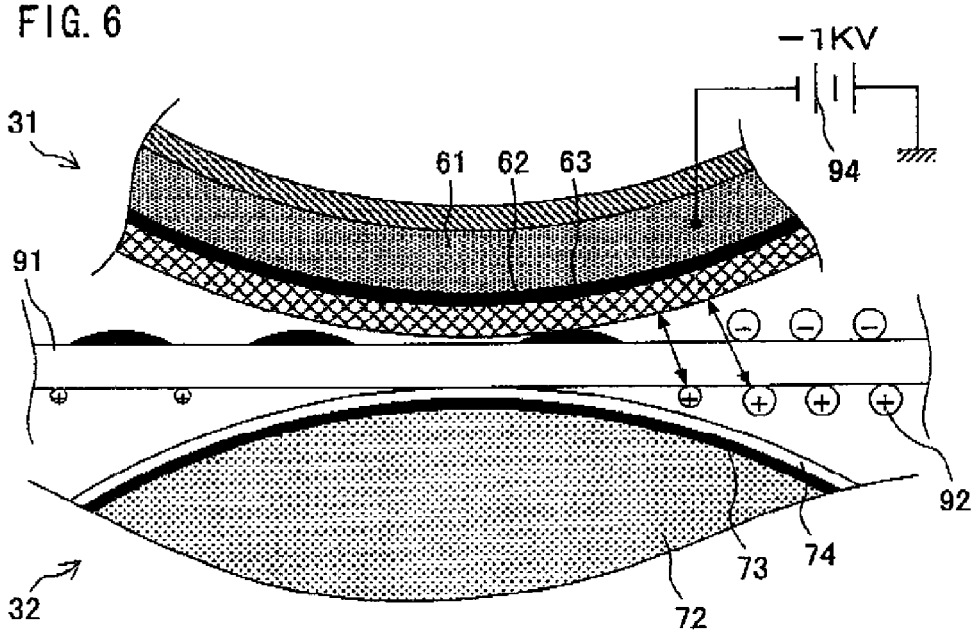

FIG. 7

| VOLUME RESISTIVITY (Ω·cm) OF SURFACE INSULATING LAYER OF FIXING ROLLER | VOLUME RESISTIVITY (Ω·cm) OF SURFACE RESISTIVE LAYER OF PRESSURE ROLLER | POLARITY OF REVERSE POLARITY TONER | FIXING BIAS VOLTAGE (V) | DEGREE OF CONTAMINATION (○、△、×) |
|---|---|---|---|---|
| $10^{17}$~$10^{19}$ Ω·cm | $10^{12}$ Ω·cm | + | −500 | △ |
| $10^{17}$~$10^{19}$ Ω·cm | $10^{12}$ Ω·cm | + | −1000 | ○ |
| $10^{17}$~$10^{19}$ Ω·cm | $10^{12}$ Ω·cm | + | −1500 | ○ |
| $10^{17}$~$10^{19}$ Ω·cm | $10^{12}$ Ω·cm | + | −2000 | — |
| $10^{17}$~$10^{19}$ Ω·cm | $10^{12}$ Ω·cm | + | +500 | × |
| $10^{17}$~$10^{19}$ Ω·cm | $10^{7}$ Ω·cm | + | −500 | ○ |
| $10^{17}$~$10^{19}$ Ω·cm | $10^{7}$ Ω·cm | + | −1000 | ○ |
| $10^{10}$~$10^{12}$ Ω·cm | $10^{12}$ Ω·cm | + | −500 | × |

○ : SLIGHTLY CONTAMINATED
△ : MODERATELY CONTAMINATED
× : TERRIBLY CONTAMINATED

FIG. 9

| VOLUME RESISTIVITY (Ω·cm) OF SURFACE INSULATING LAYER OF FIXING ROLLER | VOLUME RESISTIVITY (Ω·cm) OF SURFACE RESISTIVE LAYER OF PRESSURE ROLLER | POLARITY OF REVERSE POLARITY TONER | FIRST FIXING BIAS VOLTAGE (V) | SECOND FIXING BIAS VOLTAGE (V) | DEGREE OF CONTAMINATION (○、△、×) |
|---|---|---|---|---|---|
| $10^{17}$~$10^{19}$Ω·cm | $10^{12}$Ω·cm | + | −1000 | 0 | △ |
| $10^{17}$~$10^{19}$Ω·cm | $10^{12}$Ω·cm | + | −1000 | +500 | ○ |
| $10^{17}$~$10^{19}$Ω·cm | $10^{17}$Ω·cm | + | −1000 | +1000 | ○ |
| $10^{17}$~$10^{19}$Ω·cm | $10^{17}$Ω·cm | + | −1000 | +1000 | △ |
| $10^{17}$~$10^{19}$Ω·cm | $10^{17}$Ω·cm | + | −1000 | +1600 | ○ |
| $10^{10}$~$10^{12}$Ω·cm | $10^{12}$Ω·cm | + | −1000 | +1000 | △ |
| $10^{10}$~$10^{12}$Ω·cm | $10^{7}$Ω·cm | + | −1000 | +1000 | × |

○ : SLIGHTLY CONTAMINATED
△ : MODERATELY CONTAMINATED
× : TERRIBLY CONTAMINATED

HEAT-RECEIVING SURFACE
(SURFACE WHICH IS IN CONTACT WITH ROLLER)

FIXING METHOD, FIXING DEVICE, AND IMAGE FORMING APPARATUS

TECHNICAL FIELD

The present invention relates to a fixing method and a fixing device which are used in an electrophotographic device, such as a copier and a printer, and also relates to an image forming apparatus.

BACKGROUND ART

In a fixing device, a drying device, an erasing device, and a printing device of an image forming apparatus using an electrophotographic printing method, a fixing member and a pressure member which are rollers or belts sandwich and feed a printing medium on which an unfixed image or a printed image is formed with a developer (toner, etc.). While the printing medium is being fed, the unfixed image or the printed image is melted or dried by heat, so that the unfixed image or the printed image is, for example, fixed to the printing medium.

As shown in FIG. 2 which explains the present embodiment, for example, the image forming apparatus using the electrophotographic printing method includes (i) an image forming section which includes a photosensitive drum 1 and respective means provided around the photosensitive drum 1 and (ii) a fixing section which is provided downstream of the image forming section in a feeding direction of the printing medium and includes a fixing device 14. In the image forming section, a toner image is formed on the photosensitive drum 1, and then the toner image is transferred to the printing medium. In the fixing section, the printing medium is sandwiched by a nip portion between the fixing member (fixing roller 31) and the pressure member (pressure roller 32), and while the printing medium is being fed, the toner image is heated and melted so that the toner image is fixed on the printing medium.

Here, if (i) a reverse polarity toner (a reverse polarity developer) adheres to, for example, the back surface of the printing medium in the image forming section, and (ii) an electrostatic force (electrostatic force in a direction of the pressure roller 32) with respect to the toner of the fixing roller 31 or the pressure roller 32 is stronger than releasability with respect to the toner, the reverse polarity toner melts and adheres to the pressure roller 32. Moreover, the reverse polarity toner adheres to a second heating member, a cleaning member, etc. which are in contact with the pressure roller 32, and further the reverse polarity toner adheres again to the fixing roller 31 or both surfaces of the printing medium. Thus, an image failure occurs on an image of the printing medium.

Moreover, if the amount of toner (reverse polarity toner) which is not fixed onto the printing medium but is accumulated on respective means increases, it becomes impossible to secure functions of those means, and this interferes a normal image forming operation. Moreover, it becomes impossible to maintain an image-forming function over the long term, and the life of the means become extremely short.

Here, as a conventional technique, Japanese Patent Publication No. 2,734,146 (published on Aug. 19, 1991) discloses a technique of preventing contamination caused by the toner adhered to the fixing member. This conventional technique prevents the contamination by (i) applying to the fixing member a bias voltage having the same polarity as the toner and (ii) defining a volume resistivity of a surface release layer of the fixing member.

However, the technique disclosed in this Publication does not have a satisfactory function of preventing the contamination caused by the reverse polarity toner adhered to the back surface of the printing medium. Therefore, the problem of the contamination by the reverse polarity toner still exists, and it is still impossible to maintain the function of the image forming apparatus over the long term.

Therefore, an object of the present invention is to provide a fixing method, a fixing device, and an image forming apparatus which can prevent the image failure caused by the reverse polarity toner, maintain the normal image forming operation, and secure a satisfactory image quality and the life of each means over the long term.

DISCLOSURE OF INVENTION

To solve the above-described problems, a fixing device of the present invention includes a fixing member which is in contact with an unfixed image formed on a printing medium with a developer and a pressure member which is in contact with the fixing member. In this fixing device, the fixing member and the pressure member sandwiches the printing medium so as to feed the printing medium, so that the unfixed image on the printing medium is fixed on the printing medium. Moreover, the fixing device further includes holding electric field generating means for generating a holding electric field which is an electric field in a direction for holding a reverse polarity developer on the printing medium. Note that the reverse polarity developer has a polarity opposite to a polarity of the developer which forms an image on the printing medium.

The above-described fixing device may be configured such that the holding electric field generating means includes bias voltage applying means for applying a bias voltage, which generates the holding electric field, to at least one of the fixing member and the pressure member.

The above-described fixing device may be configured such that the bias voltage applying means applies as the bias voltage a voltage, having a polarity opposite to a polarity of the reverse polarity developer, to the fixing member.

The above-described fixing device may be configured such that the bias voltage applying means applies as the bias voltage a voltage, having the same polarity as the reverse polarity developer, to the pressure member.

The above-described fixing device may be configured such that a time it takes for a potential to decay is 0.2 second or longer, the potential being produced by the bias voltage on a surface of a member to which the bias voltage is applied.

The above-described fixing device may be configured such that an absolute value of a current is 0.05 μA or more and 150 μA or less, the current flowing when the bias voltage is applied and flowing in a member to which the bias voltage is applied.

The above-described fixing device may be configured such that the fixing member includes a conductive core bar, an intermediate layer on the conductive core bar, and a surface insulating layer on the intermediate layer.

The above-described fixing device may be configured such that the fixing member includes a surface resistive layer on the surface thereof, the surface resistive layer has a surface resistivity of $10^{14}$ Ω or higher, and the bias voltage applying means applies the bias voltage to the fixing member.

The above-described fixing device may be configured such that the fixing member includes a surface resistive layer on the surface thereof, the surface resistive layer has a volume resistivity higher than $10^{13}$ Ω·cm, and the bias voltage applying means applies the bias voltage to the fixing member.

The above-described fixing device may be configured such that (i) the pressure member includes a conductive core bar, an insulating elastic layer on the conductive core bar, an intermediate layer on the insulating elastic layer, and a surface resistive layer on the intermediate layer, (ii) a potential given member is provided on a surface of the pressure member, (iii) the bias voltage applying means applies the bias voltage to the potential given member, and (iv) the bias voltage is applied through the potential given member to a surface of the pressure member or near -the surface of the pressure member.

The above-described fixing device may be configured such that the surface resistive layer of the above-described fixing device has a surface resistivity of $10^7$ Ω or higher, and the bias voltage applying means applies the bias voltage to the pressure member.

The above-described fixing device may be configured such that the surface resistive layer of the above-described fixing device has a volume resistivity of $10^5$ Ω·cm or higher, and the bias voltage applying means applies the bias voltage to the pressure member.

The above-described fixing device may be configured such that the fixing member includes first heating means for heating a surface of the fixing member, and the potential given member also functions as second heating means for heating the surface of the pressure member.

The above-described fixing device may be configured such that the potential given member is a cleaning member for removing the developer remaining on the surface of the pressure member.

The above-described fixing device may be configured such that the potential given member is a conductive electrode member or a semiconductive electrode member.

The above-described fixing device may be configured such that the bias voltage is applied from first bias voltage applying means to the fixing member, and the bias voltage is applied from second bias voltage applying means to the potential given member.

The above-described fixing device may be configured so as to further include at least one temperature detecting element which detects surface temperatures of the fixing member, the pressure member, and the heating member, and the temperature detecting element includes an insulating film layer and a heat-resistant release layer on a heat-receiving surface of the temperature detecting element and a protective layer on a surface opposite to the heat-receiving surface.

The above-described fixing device may be configured such that the insulating film layer, the heat-resistant release layer, and the protective layer of the temperature detecting element are extended to a housing of the temperature detecting element so as to cover an elastic member (for example, a stainless steel plate (elastic member) to which a thermistor chip (temperature detecting element) is bonded) of the temperature detecting element.

A fixing method of the present invention fixes an unfixed image, formed on a printing medium with a developer, on the printing medium by sandwiching and feeding the printing medium by a fixing member which is in contact with the unfixed image and a pressure member which is in contact with the fixing member, and the fixing method includes the step of giving a holding electric field which is an electric field in a direction for holding a reverse polarity developer on the printing medium. Note that the reverse polarity developer has a polarity opposite to a polarity of the developer which forms an image on the printing medium.

In the above-described fixing method, the holding electric field may be given by applying a bias voltage to at least one of the fixing member and the pressure member.

An image forming apparatus of the present invention includes any one of the above-described fixing devices.

The above-described image forming apparatus may be configured so as to include a transfer device which is provided upstream of the fixing device in a feeding direction of the printing medium and which transfers a developer image from a developer image carrier to the printing medium, and the transfer device uses a contact transfer method in which the transfer device is in contact with the developer image carrier.

Note that the upper limit of each of (i) the surface resistivity of $10^{14}$ Ω or higher, (ii) a value higher than the surface resistivity of $10^{13}$ Ω·cm, (iii) the surface resistivity of $10^7$ Ω or higher, and (iv) the volume resistivity of 105 Ω·cm or higher may be any value as long as the value indicates an insulation. Specifically, the upper limit may be (i) on the order of $10^{24}$ Ω which is the maximum value a super high resistance meter can measure, or (ii) on the order of $10^{20}$ Ω which is a practical value in manufacturing.

As described above, the fixing device of the present invention includes the holding electric field generating means for generating the holding electric field which is an electric field in a direction for holding the developer on the printing medium, and the developer has a polarity opposite to that of the developer which forms the image on the printing medium. In addition, the fixing method of the present invention includes the step of giving the holding electric field in a direction for holding the developer on the printing medium, and the developer has a polarity opposite to that of the developer which forms the image on the printing medium. Therefore, the following effect can be obtained.

For example, in an image forming apparatus using the electrophotographic printing method, an unfixed developer image (for example, an unfixed toner image) is formed on an image forming carrier in a development process, and the unfixed developer image is transferred to the printing medium in a transfer process. Then, the unfixed toner image on the printing medium is fixed on the printing medium in a fixing process carried out by the fixing device.

Here, on the printing medium which has been subjected to the transfer process, there are a regularly electrified toner (hereinafter referred to as "regular toner") which forms the toner image and a developer (hereinafter referred to as "reverse polarity toner") which is electrified so as to have a polarity opposite to that of the regular toner.

The regular toner forms on the image forming carrier a visible image corresponding to a latent image. Then, in the transfer process, the regular toner is transferred as an unfixed image to a surface of the printing medium. Note that this surface of the printing medium is in contact with the fixing member. Meanwhile, if a contact method is used in the transfer process and a transfer roller or a transfer belt is used as a transfer member, the reverse polarity toner moves from the image forming carrier to the transfer member by the electrostatic force, generated by a transfer bias, at the time when the printing medium does not exist between the image forming carrier and the transfer member. As a result, the reverse polarity toner sticks to the surface of the transfer member.

The reverse polarity toner moved to the transfer member is usually removed in a cleaning process in which a blade or the electrostatic force is used. However, the reverse polarity toner is not removed completely, and some of the reverse polarity toner remain on the transfer member. For example, in the case of using the regular toner electrified negatively, the remaining reverse polarity toner electrified positively adheres from the transfer member to the back surface of the printing medium by a Van der Waals force, a bridging force, or the other force when the transfer process is being carried out with respect to the following printing medium, and then the reverse polarity toner is delivered to the fixing device which carries out the fixing process.

In the fixing process in which frictional electrification is generated by rotation of the fixing member and the pressure member which are in contact with each other, if the surfaces of the fixing member and the pressure member are electrified negatively, the positively-electrified reverse polarity toner on the back surface of the printing medium is removed from the back surface of the printing medium easily, is attracted by the positive electric charge on the pressure member, and moves to the surface of the pressure member.

In this case, the reverse polarity toner melts by the heat in the fixing process, and adheres to and remains on the surface of the pressure member. Therefore, if the pressure member is left as it is, the surface of the pressure member is contaminated by the reverse polarity toner. Further, if the amount of the reverse polarity toner is large, the regular toner may be attracted by the reverse polarity toner. Thus, the contamination of the pressure member becomes more terrible. Moreover, the toner may adhere to the back surface of the following printing mediums, and causes the image failure.

Moreover, when the printing medium does not exist between the fixing member and the pressure member which are in contact with each other and rotate, the reverse polarity toner moves from the surface of the pressure member to the surface of the fixing member by the releasability of the surface of the pressure member. In this case, the reverse polarity toner moves from the surface of the fixing member to the surface (surface on which an image is formed) of the printing medium which is subjected to the fixing process. As a result, the image failure occurs on this printing medium.

Here, in the fixing process, the present invention gives the holding electric field in a direction for holding the reverse polarity toner (a developer having a polarity opposite to that of the developer which forms the image on the printing medium) on the printing medium. With this, the reverse polarity toner adhered to the back surface of the printing medium does not move to the pressure member, and stays on the back surface of the printing medium. Therefore, in the fixing process, the reverse polarity toner adhered to the back surface of the printing medium is output with the reverse polarity toner fixed on the back surface of the printing medium. Since the amount of the reverse polarity toner adhered to the back surface of a single printing medium is small, the image defect does not occur even when the reverse polarity toner is fixed on the back surface of the printing medium.

With this, the configuration of the present invention can prevent the image failure caused by the reverse polarity toner and maintain the normal image forming operation. Moreover, since the contamination of the pressure member is prevented, it is possible to simplify a mechanism (for example, an oil applying mechanism) necessary for cleaning the pressure member and demolding. Further, since it is possible to prevent the reverse polarity toner from adhering to the other functional means, it is possible to secure a satisfactory image quality and the life of each means even in long-term use.

In the above-described fixing device, the holding electric field generating means includes the bias voltage applying means for applying the bias voltage, which generates the holding electric field, to at least one of the fixing member and the pressure member, and in the above-described fixing method, the holding electric field is generated by applying the bias voltage to at least one of the fixing member and the pressure member. Therefore, the holding electric field in a direction for holding the reverse polarity developer (for example, the reverse polarity toner) on the printing medium can be generated by applying the bias voltage, which generates the holding electric field, to at least one of the fixing member and the pressure member.

In the above-described fixing device, in the case in which the bias voltage applying means is configured so as to apply to the fixing member as the bias voltage a voltage having a polarity opposite to that of the reverse polarity toner, the electrostatic force from the fixing member acts so as to cause the reverse polarity toner to stay on the back surface of the printing medium. Thus, it is possible to prevent the adhesion of the reverse polarity developer to the pressure member.

That is, by the electrostatic force (electrostatic attraction) which acts in a direction of the pressure member, the reverse polarity toner tends to overcome the other adhesive forces and move from the back surface of the printing medium to the surface of the pressure member. Here, the bias voltage having a polarity opposite to that of the reverse polarity toner is applied to the fixing member, so that the electrostatic force (electrostatic attraction) which acts from the fixing member to the reverse polarity toner acts with respect to the reverse polarity toner and is made stronger than the electrostatic force which acts in a direction of the pressure member. With this, the transfer of the reverse polarity toner to the pressure member is controlled, and the reverse polarity toner is caused to stay on the back surface of the printing medium. As a result, the amount of the reverse polarity toner adhered to the surface of the pressure member is reduced drastically, and it is possible to avoid a trouble caused by the contamination of the surface of the pressure member. Note that the contamination of the surface of the pressure member is caused by the accumulation of the reverse polarity toner on the surface of the pressure member. Moreover, it is possible to extend the life of each means much longer than the life of conventional means.

In the above-described fixing device, in the case in which the bias voltage applying means is configured so as to apply to the pressure member as the bias voltage a voltage having the same polarity as the reverse polarity toner, the electrostatic force from the pressure member acts so as to cause the reverse polarity toner to stay on the back surface of the printing medium, as in the above case. Thus, it is possible to prevent the adhesion of the reverse polarity toner to the pressure member.

That is, by the bias voltage applied to the pressure member, the electrostatic force (electrostatic repulsive force) in a direction for holding the reverse polarity toner on the printing medium acts from the pressure member to the reverse polarity toner. With this, the reverse polarity toner stays on the printing medium and is output from the fixing device. As a result, the amount of the reverse polarity toner adhered to the surface of the pressure member is reduced drastically, and it is possible to avoid a trouble caused by the contamination of the surface of the pressure member. Note that the contamination of the surface of the pressure member is caused by the accumulation of the reverse polarity toner on the surface of the pressure member. Moreover, it is possible to extend the life of each means much longer than the life of conventional means.

In the above-described fixing device, the following effect can be obtained in the case in which a time it takes for a potential to decay is 0.2 second or longer. Note that the potential is generated by the bias voltage on the surface of a member to which the bias voltage is applied.

The function of causing the reverse polarity toner to stay on the printing medium by the application of the bias voltage to the fixing member and/or the pressure member can be obtained by the action of the electrostatic force generated by the potential to be maintained on the surfaces of the fixing member and/or the pressure member as a result of the application of the bias voltage. Therefore, if the electrostatic force which acts with respect to the reverse polarity toner becomes weak because the surface potential of the fixing member and/or -the surface potential of the pressure member decay during the rotation of the fixing member and/or the rotation of the pressure member, it becomes impossible to cause the reverse polarity toner to stay on the printing medium.

Here, as a result of a consideration of the rotation speed of the fixing member and the rotation speed of the pressure member, the time it takes for the surface potential of the fixing member or the pressure member, to which the bias voltage is applied, to decay is set to 0.2 second or longer. With this, it is possible to secure a time for maintaining the surface potential of the fixing member or the pressure member, and it is also possible to adequately give the action of causing the reverse polarity toner to stay on the printing medium. Therefore, it is possible to avoid, for example, a trouble caused by the accumulation of the reverse polarity toner on the surface of the pressure member, that is, an image failure caused by the adhesion of the reverse polarity toner on the back surface of the printing medium, or an image failure caused on the surface of the printing medium by the adhesion of the reverse polarity toner from the surface of the pressure member back to the fixing member.

Note that the time it takes for the surface potential to decay (0.2 second or longer) is, for example, a time it takes for the surface potential to decay so that the surface potential is a predetermined potential or lower. That is, the time it takes for the surface potential to decay (0.2 second or longer) is a time during which the potential (predetermined potential) capable of overcoming the other forces and generating the electrostatic force necessary for holding the reverse polarity toner on the printing medium is maintained.

In the above-described fixing device, the following effect can be obtained in the case in which an absolute value of a current is 0.05 μA or more and 150 μA or less, the current flowing when the bias voltage is applied and flowing in a member to which the bias voltage is applied.

That is, the potential maintained on the surface of the fixing member and/or the pressure member when the bias voltage is applied realizes the action of causing the reverse polarity toner to stay on the printing medium. In this case, if an electric charge is applied to the surfaces of the fixing member and/or the pressure member more than necessary, or if the potential of the surfaces is increased excessively, the amount of the leak current leaking to members which does not require the current increases, and the noise, etc. caused by the leak current causes a trouble in the control system and the image processing system.

Therefore, to prevent these troubles, it is necessary to control the amount of the current supplied when the bias voltage is applied to the fixing member and/or the pressure member. That is, it is preferable that the upper limit of the current be 150 μA or less since this upper limit does not cause the noise, etc. Meanwhile, depending on the amount of the electric charge of the reverse polarity toner, it is preferable that the lower limit of the current be 0.05 μA or more since this lower limit is a minimum current necessary for holding the reverse polarity toner on the printing medium. Note that it is further preferable that the amount of the current be from 1 μA to 40 μA. Especially, in the constant voltage control, to secure the necessary electric charge and potential, it is preferable to prevent the generation of the high voltage and not to cause too much current to flow, taking surrounding environment into consideration. In addition, it is preferable to adequately consider the path of the current.

In the above-described fixing device, the following effect can be obtained in the case in which (i) the surface insulating layer of the fixing member has the surface resistivity of $10^{14}$ Ω or higher and (ii) the bias voltage applying means applies the bias voltage to the fixing member.

As described above, to cause the reverse polarity toner to stay on the printing medium by the electrostatic force generated by the application of the bias voltage to the fixing member, it is necessary to keep the surface potential of the fixing member (it is necessary to maintain the electric charge on the surface of the fixing member). For this, it is preferable that the surface resistivity of the surface insulating layer of the fixing member be a predetermined value.

That is, if the surface resistivity of the surface insulating layer of the fixing member is $10^{14}$ Ω or higher, the time for maintaining the electric charge can be increased. With this, it is possible to obtain a desired effect of causing the reverse polarity toner to stay on the printing medium. Note that the above-described surface resistivity can be selected accordingly from $10^{15}$ Ω or higher, $10^{17}$ Ω or higher, etc., depending on a combination of various configurations of the rollers, the materials of the rollers, and the material of the toner, the processing speed, the spec of the image forming apparatus, etc.

In the above-described fixing device, the following effect can be obtained in the case in which- (i) the fixing member includes the surface resistive layer on the surface thereof, (ii) the volume resistivity of the surface resistive layer is $10^{13}$ Ω·cm or higher, and (iii) the bias voltage applying means applies the bias voltage to the fixing member.

As described above, to cause the reverse polarity toner to stay on the printing medium by the electrostatic force generated by the application of the bias voltage to the fixing member, it is necessary to keep the surface potential of the fixing member (it is necessary to maintain the electric charge on the surface of the fixing member). For this, it is preferable that the volume resistivity of the surface insulating layer of the fixing member be a predetermined value.

That is, if the volume resistivity of the surface insulating layer of the fixing member is $10^{13}$ Ω·cm or higher, the time for maintaining the electric charge can be increased. With this, it is possible to obtain a desired effect of causing the reverse polarity developer to stay on the printing medium. Note that the above-described volume resistivity can be selected accordingly from $10^{14}$ Ω·cm or higher, $10^{15}$ Ω·cm or higher, $10^{18}$ Ω·cm or higher, etc., depending on a combination of various configurations of the rollers, the materials of the rollers, and the material of the toner, the processing speed, the spec of the image forming apparatus, etc.

In the above-described fixing device, the following effect can be obtained in the case in which (i) the pressure member includes the insulating elastic layer on the conductive core bar, the intermediate layer on the insulating elastic layer, and the surface resistive layer on the intermediate layer, (ii) the potential given member is provided on the surface of the pressure member, (iii) the bias voltage applying means applies the bias voltage to the potential given member, and (iv) the bias voltage is applied through the potential given member to the surface of the pressure member or near the surface of the pressure member.

That is, since the pressure member includes the insulating elastic layer, it is preferable that the bias voltage be applied to the surface resistive layer of the pressure member. In this case, to surely give the potential (electric charge), for holding the reverse polarity toner on the printing medium, to the surface resistive layer of the pressure member, the bias voltage is applied to the potential given member, and the potential (electric charge) is given to the pressure member by the electric charge transfer from the potential given member. The potential given member is provided so as to be in contact with the surface of the pressure member or so as to be close to the surface of the pressure member.

The giving of the potential (electric charge) to the pressure member by the potential given member can realize a more stable giving of the potential (electric charge) than the giving of the potential (electric charge) by a conventional corona charger, and moreover, terrible environmental contamination does not occur. Note that the potential applied voltage can be in the form of a plate (knife-edge, sawtooth), a brush, a cylinder, a cylindrical column, or the like.

In the above-described fixing device, the following effect can be obtained in the case in which (i) the surface resistivity of the surface resistive layer of the pressure member is $10^7$ Ω or higher, and (ii) the bias voltage applying means applies the bias voltage to the pressure member.

To cause the reverse polarity toner to stay on the printing medium by the electrostatic force generated by the application of the bias voltage to the pressure member, it is necessary to keep the surface potential of the pressure member (it is necessary to maintain the electric charge on the surface of the pressure member), as in the above case. For this, it is preferable that the surface resistivity of the surface resistive layer of the pressure member be a predetermined value.

That is, if the surface resistivity of the surface resistive layer of the pressure member is $10^{10}$ Ω or higher, the time for maintaining the electric charge can be increased. With this, it is possible to obtain a desired effect of causing the reverse polarity toner to stay on the printing medium. Note that the above-described surface resistivity can be selected accordingly from $10^{10}$ Ω or higher, $10^{15}$ Ω or higher, etc., depending on a combination of various configurations of the rollers, the materials of the rollers, and the material of the toner, the processing speed, the spec of the image forming apparatus, etc.

In the above-described fixing device, the following effect can be obtained in the case in which (i) the volume resistivity of the surface resistive layer of the pressure member is $10^5$ Ω·cm or higher, and (ii) the bias voltage applying means applies the bias voltage to the pressure member.

To cause the reverse polarity toner to stay on the printing medium by the electrostatic force generated by the application of the bias voltage to the pressure member, it is necessary to keep the surface potential of the pressure member (it is necessary to maintain the electric charge on the surface of the pressure member), as in the above case. For this, it is preferable that the volume resistivity of the surface resistive layer of the pressure member be a predetermined value.

That is, if the volume resistivity of the surface resistive layer of the pressure member is $10^5$ Ω·cm or higher, the time for maintaining the electric charge can be increased. With this, it is possible to obtain a desired effect of causing the reverse polarity toner to stay on the printing medium. Note that the above-described volume resistivity can be selected accordingly from $10^7$ Ω·cm or higher, $10^{10}$ Ω·cm or higher, $10^{15}$ Ω·cm or higher, etc., depending on a combination of various configurations of the rollers, the materials of the rollers, and the material of the toner, the processing speed, the spec of the image forming apparatus, etc.

In the above-described fixing device, the following effect can be obtained in the case in which (i) the fixing member includes a first heating member for heating the surface of the fixing member, and (ii) the potential given member also functions as a second heating member for heating the surface of the pressure member.

That is, the fixing device is configured such that the surface of the pressure member is heated by the second heating member. In this configuration, since the potential given member also functions as the second heating member, it is possible to simplify the arrangement around the pressure member, and also possible to realize a simple configuration of the fixing device. Moreover, since the potential given member carries out the heating and the application of the bias voltage simultaneously, it is possible to prevent the adhesion of the reverse polarity toner to the fixing member and the potential given member, and also possible to heat the fixing member.

In the above-described fixing device, in the case in which the potential given member is a cleaning member for cleaning the toner remaining on the surface of the pressure member, the potential given member can also function as the cleaning member for the pressure member. With this, it is possible to simplify the arrangement around the pressure member, and also possible to realize a simple configuration of the fixing device.

In the above-described fixing device, in the case in which the potential given member is a conductive or semiconductive electrode member in the form of a knife-edge, a sawtooth, a brush, or the like, the potential given member can be configured simply so as to specialize in a potential given member function (that is, so as to specialize only in a function of giving a potential to a target object).

In the above-described fixing device, in the case in which (i) the bias voltage is applied from the first bias voltage applying means to the fixing member, and (ii) the bias voltage is applied from the second bias voltage applying means to the potential given member, the electrostatic force (electrostatic attraction) for holding the reverse polarity toner on the printing medium acts from -the fixing member to the reverse polarity toner on the printing medium, and the electrostatic force (electrostatic repulsive force) for holding the reverse polarity toner on the printing medium acts from the pressure member to the reverse polarity toner on the printing medium. Therefore, it is possible to further improve the function of causing the reverse polarity toner to stay on the printing medium.

The above-described fixing device further includes the temperature detecting element which detects surface temperatures of the fixing member, the pressure member, and the heating member. For example, one temperature detecting element may be provided for each of the fixing member, the pressure member, and the heating member, or one temperature detecting element may be provided for each of the fixing member and the heating member. In addition, the temperature detecting element includes the insulating film layer and the heat-resistant release layer on the heat-receiving surface of the temperature detecting element, and the protective layer on a surface opposite to the heat-receiving surface. With this, the heat-receiving surface of the temperature detecting element has electric insulation, so that the small amount of toner adhered to the surface of the roller does not adhere to the temperature detecting element. Therefore, the temperature control performance is improved.

That is, the insulating film layer protects the temperature detecting element from the bias voltage and the leak by the frictional electrification, and the heat-resistant release layer prevents the melted toner from adhering to the heat-receiving surface of the temperature detecting element.

In the above-described fixing device, the insulating film layer, heat-resistant release layer, and protective layer of the temperature detecting element are extended to a housing of the temperature detecting element so as to cover the elastic member of the temperature detecting element. With this, the elastic member is not exposed to the bias voltage and the leak from the roller which is electrified by friction. Therefore, even in the case in which the elastic member has excellent electric conductivity, it is possible to secure a most appropriate insulation distance, and also possible to avoid a trouble caused by the high voltage.

Moreover, the following effect can be obtained in the case in which (i) the above-described image forming apparatus further includes the transfer device which is provided upstream of the fixing device in a feeding direction of the printing medium and which transfers the developer image from the developer image carrier to the printing medium, and (ii) the transfer device is a transfer device using a contact transfer method, that is, the transfer device is in contact with the developer image carrier.

In the case in which the transfer device provided upstream of the fixing device is the transfer device using the contact transfer method, the larger amount of the reverse polarity toner tends to adhere to the back surface of the printing medium in the transfer device using the contact transfer method than in a transfer device using a non-contact transfer method, because of the influence of removing the printing medium from the transfer member which is rollers or belts. Therefore, in the case of the contact transfer method using the transfer device which is the rollers or the belts, the configuration including the fixing device of the present invention is very effective.

Even if the ability of cleaning the surface of the transfer device using the contact transfer method is reduced and the reverse polarity toner is delivered to the fixing device, the adhesion and accumulation of the reverse polarity toner to the pressure member is prevented, and the image failure and the image defect can be prevented appropriately.

Additional objects, features, and strengths of the present invention will be made clear by the description below. Further, the advantages of the present invention will be evident from the following explanation in reference to the drawings.

BRIEF DESCRIPTION OF DRAWINGS

FIG. 6 is a vertical cross-sectional view showing important members and how a printing medium is sandwiched between a fixing roller and a pressure roller in the fixing device shown in FIG. 1.

FIG. 7 is an explanatory diagram showing a relation between a fixing bias voltage in the fixing device shown in FIG. 1 and the degree of an image failure on the printing medium.

FIG. 9 is an explanatory diagram showing a relation between a fixing bias voltage in the fixing device shown in FIG. 8 and the degree of an image failure on the printing medium.

FIG. 13(*b*) is a plan view showing a thermistor of an embodiment of the present invention.

BEST MODE FOR CARRYING OUT THE INVENTION

Embodiment 1

The following will explain one embodiment of the present invention in reference to the figures.

Figure 2:
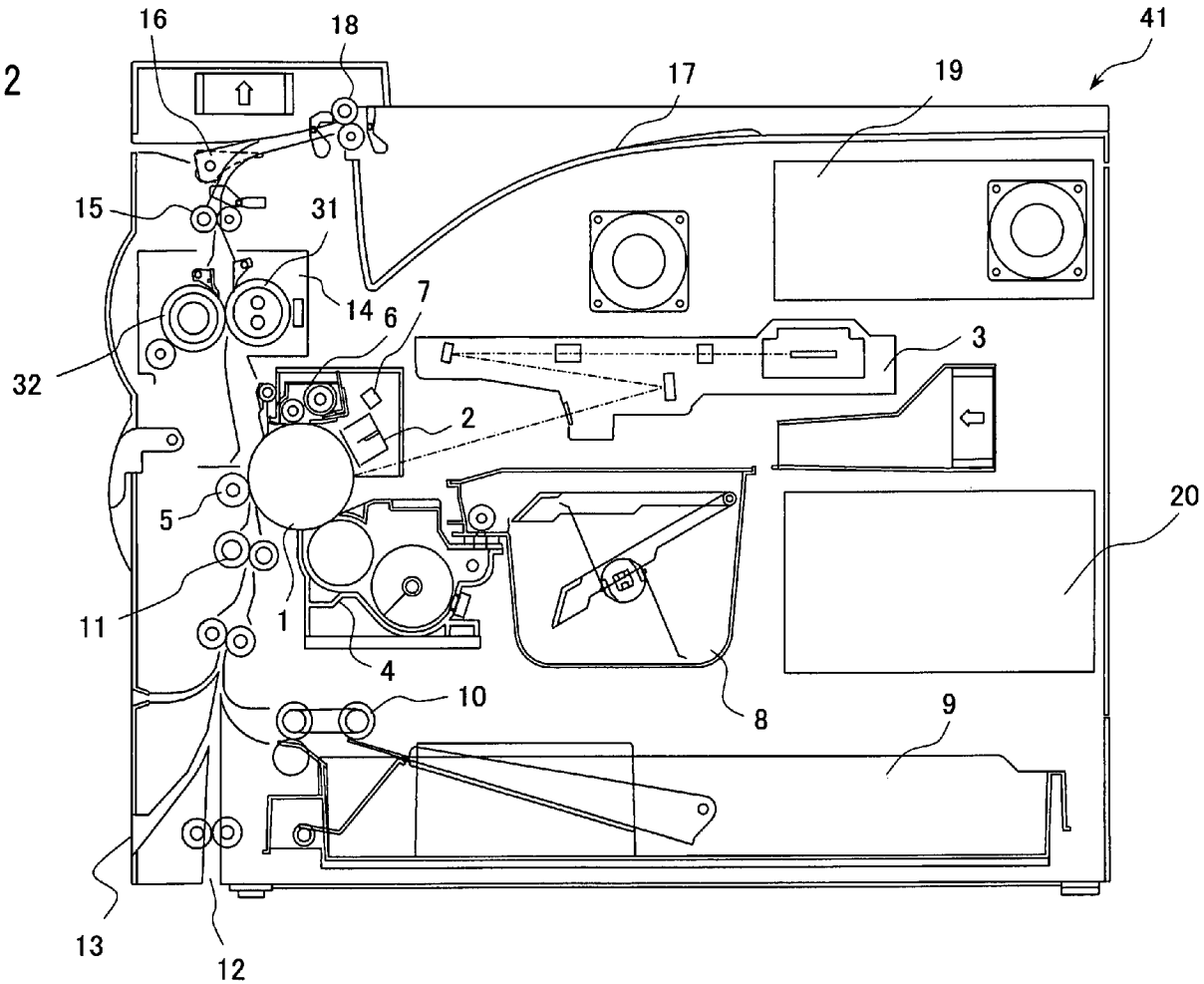
FIG. 2 is a front view showing an internal configuration of an image forming apparatus, using an electrophotographic printing method, of one embodiment of the present invention.

FIG. 2 is a front view showing an internal configuration of an image forming apparatus, using an electrophotographic printing method, of the present embodiment. This image forming apparatus 41 records and outputs (i) an image read by an image reading device 42 (see FIG. 3) or (ii) as an image, data supplied from a device (an image processing device, such as a personal computer) externally connected to the image forming apparatus 41.

In the image forming apparatus 41, process units each having a function in an image forming process are provided around a photosensitive drum 1, and these process units forms an image forming section. Around the photosensitive drum 1, an electrifying device 2, a light scanning device 3, a developing device 4, a transfer device 5, a cleaning device 6, an electricity removing device 7, etc. are sequentially provided in a rotation direction of the photosensitive drum 1.

The electrifying device 2 uniformly electrifies the surface of the photosensitive drum 1. The light scanning device 3 forms an optical image on the uniformly-electrified photosensitive drum 1 so as to write an electrostatic latent image on the photosensitive drum 1. The developing device 4 visualizes the electrostatic latent image, written by the light scanning device 3, with a developer supplied from a developer supplying container 8. The transfer device 5 transfers onto the printing medium an image visualized on the photosensitive drum 1. The cleaning device 6 removes the developer remaining on the photosensitive drum 1 so that a new image can be formed on the photosensitive drum 1. The electricity removing device 7 removes electric charge from the surface of the photosensitive drum 1.

A feeding tray 9 is included in the image forming apparatus 41 and locates in a lower area of the image forming apparatus 41. This feeding tray 9 is a printing medium storing tray for storing the printing mediums. The printing mediums stored in the feeding tray 9 are separated one-by-one by, for example, a pickup roller 10, and are fed to a resist roller 11. Then, the resist roller 11 adjusts the timing of the printing medium and an image formed on the photosensitive drum 1, and the printing mediums are sequentially fed to a portion between the transfer device 5 and the photosensitive drum 1. Then, the image recorded and reproduced on the photosensitive drum 1 is transferred onto the printing medium. Note that the printing mediums are placed in the feeding tray 9 by pulling the feeding tray to the front side (operation side) of the image forming apparatus 41.

Figure 3:
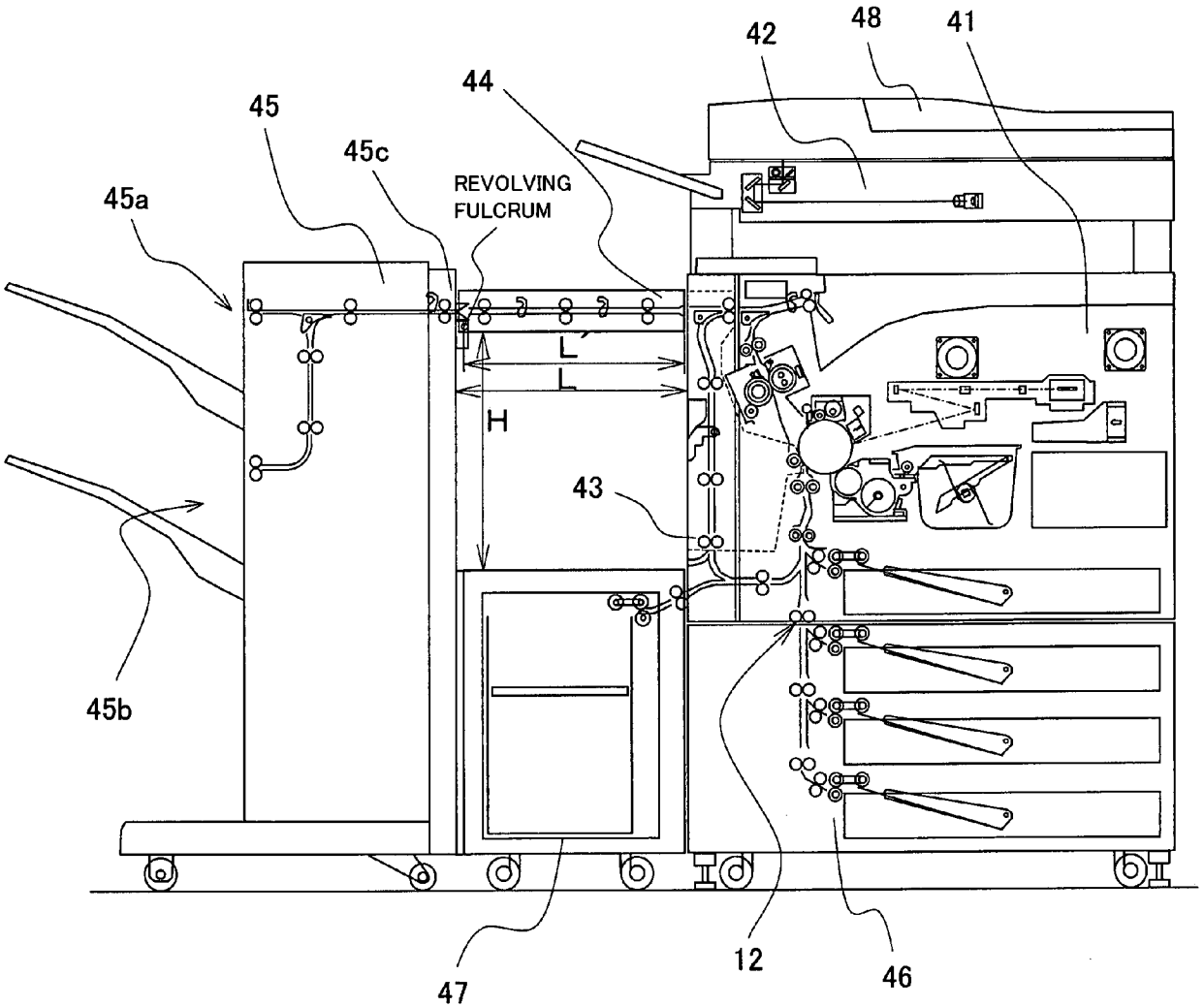
FIG. 3 is a front view showing an internal configuration of an image forming system including the image forming apparatus shown in FIG. 2.

Printing medium receiving openings 12 and 13 are formed at a lower surface of the image forming apparatus 41. As shown in FIG. 3, the printing medium receiving openings 12 and 13 receives the printing mediums supplied from a peripheral device, such as (i) a printing medium feeding device 46 having a plurality of printing medium feeding trays and (ii) a printing medium feeding device 47 capable of storing a large number of printing mediums. Moreover, the printing medium receiving openings 12 and 13 sequentially feed the printing mediums toward the image forming section.

A fixing device 14 is included in the image forming apparatus 41 and locates in an upper area of the image forming apparatus 41. The fixing device 14 sequentially receives the printing medium to which an image is transferred, and fixes the image by heat and pressure of a fixing roller 31 (fixing member), a pressure roller 32 (pressure member), etc. Thus, the image is printed on the printing medium.

The printing medium on which the image is printed is fed further upwardly by a feeding roller 15, and passes through a switch gate 16. If an output tray for the printing medium is set to an onboard tray 17 provided outside the image forming apparatus 41, the printing medium is output onto the onboard tray 17 by a reverse roller 18. Meanwhile, if a two-sided image formation or a post-processing is requested, the printing medium is once output toward the onboard tray 17 by the reverse roller 18. However, in this case, the printing medium is not completely output but remains sandwiched by the reverse roller 18, and the reverse roller 18 reverses its rotation. Thus, the printing medium is fed in an opposite direction, that is, the printing medium is fed toward a printing medium resupply feeding device 43 (see FIG. 3) or toward a post-processing device 45 (see FIG. 3). In this case, the position of the switch gate 16 is changed from a position shown by a solid line of FIG. 2 to a position shown by a dotted line of FIG. 2. Note that the printing medium resupply feeding device 43 and the post-processing device 45 are selectively attached for the two-sided image formation or the post-processing.

When carrying out the two-sided image formation, the printing medium thus turned over and fed passes through the printing medium resupply feeding device 43 and is supplied again to the image forming apparatus 41. Meanwhile, when carrying out the post-processing, the printing medium thus turned over and fed is fed from the printing medium resupply feeding device 43 through a relay feeding device 44 to the post-processing device 45 by another switch gate. Thus, the post-processing is carried out.

A control device 19 is provided above the light scanning device 3 and stores, for example, a circuit substrate which controls an image forming process and an interface substrate (s) which receives image data from an external device. Moreover, a power source device 20 is provided under the light scanning device 3 and supplies electric power to the above-described various interface substrates and the image forming process units.

The image forming apparatus 41 shown in FIG. 2 is included in an image forming system shown in FIG. 3. In addition to the image forming apparatus 41, the image forming system includes the image reading device 42, the printing medium resupply feeding device 43, the relay feeding device 44, the post-processing device 45, the printing medium feeding device 46, and the printing medium feeding device 47.

The image reading device 42 scans an image of a set document, forms the image on a CCD that is a photoelectric transducer, converts the image into an electric signal, and outputs the electric signal as image data. The image data read is processed (corrected, rasterized, etc.) by the image processing device of the image forming apparatus 41, and then an image based on the image data thus processed is written onto the photosensitive drum 1 by the light scanning device 3.

The image reading device 42 can read not only one surface of the printing medium but also both surfaces of the printing medium substantially simultaneously. Moreover, the image reading device 42 can feed the document both automatically (by an automatic document feeding device 48) and manually.

The printing medium resupply feeding device 43 is a printing medium feeding path unit attached to the left side surface of the image forming apparatus 41. In the case of using the printing medium resupply feeding device 43, (i) first, the printing medium on one surface of which an image is formed is output from the fixing device 14, is turned over by the reverse roller 18 of an output section located in an upper area of the image forming apparatus 41, and is supplied to the printing medium resupply feeding device 43, and then (ii) the printing medium resupply feeding device 43 feeds the printing medium again toward a portion (transfer portion) between the photosensitive drum 1 and the transfer device 5 of the image forming section of the image forming apparatus 41.

The relay feeding device 44 feeds the printing medium to the post-processing device 45, and is provided between the printing medium resupply feeding device 43 and the post-processing device 45.

The post-processing device 45 is located in a left area of the image forming system, and includes a first printing medium output section 45*a* and a second printing medium output section 45*b*.

Here, a receiving feeding section 45*c* is located in an upper right area of the post-processing device 45, and receives the printing medium which is output from the image forming apparatus 41 and on which the image is formed. When the printing medium thus received is output to the first printing medium output section 45*a*, the printing medium is output as-is. Meanwhile, when the printing medium thus received is output to the second printing medium output section 45*b*, the printing medium is processed by the post-processing device 45 before the printing medium is output to the second printing medium output section 45*b*. Note that which the post-processing device 45 is selectively attached for carrying out a stapling, a punching, or the like. The first printing medium output section 45*a* or the second printing medium output section 45*b* is selected accordingly by a user.

The post-processing device 45 has a few of functions of (i) stapling a predetermined number of printing mediums, (ii) folding the printing medium, such as a B4-size sheet and an A3-size sheet, (iii) punching a hole in the printing medium for filing, (iv) having several to several tens of printing medium output sections for sorting.

Figure 1:
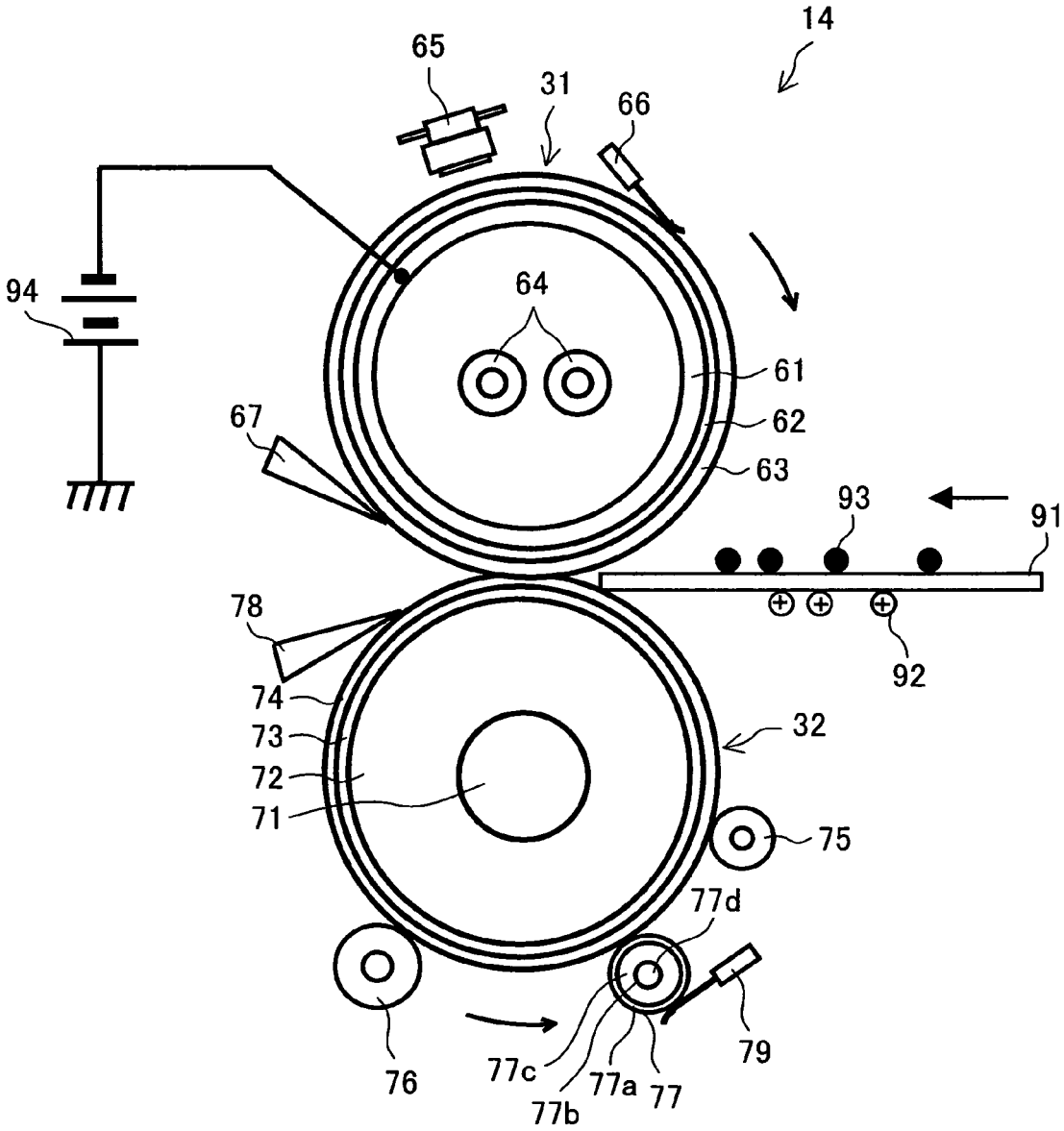
FIG. 1 is a vertical cross-sectional view schematically showing a fixing device of one embodiment of the present invention.

FIG. 1 shows the configuration of the fixing device 14 in more detail. FIG. 1 is a vertical cross-sectional view schematically showing the fixing device 14. In the fixing device 14 of FIG. 1, the fixing roller 31 includes a conductive core bar 61, and the pressure roller 32 includes a conductive core bar 71.

A large amount of aluminum, iron, and an alloy of these are used in the fixing device 31. In the present embodiment, the fixing device 31 is manufactured in such a manner that (i) an iron-based cold rolling carbon steel tube is processed by, for example, a drawing treatment so as to have a desired external diameter and thickness, and then (ii) the obtained iron-based cold rolling carbon steel tube is polished so as to have the external diameter of 40 mm and the thickness of 1.3 mm. Both end portions of the fixing roller 31 are processed by a reducing treatment so as to have the external diameter of 30 mm and the thickness of 1.5 mm, and a load applied to the fixing roller 31 is supported with a ball bearing (a type of rolling bearings) that is a shaft supporting member. The core bar 61 of the fixing roller 31 is subjected to a parkerizing treatment (a phosphate film treatment or a zinc phosphate film treatment) to prevent from rusting.

In the fixing roller 31, a center sleeve portion which is not subjected to the reducing treatment is generally made of fluorocarbon resin which can maintain the releasability even in the case of contacting with heated and melted toner. The examples of the fluorocarbon resin are PFA (copolymer of tetrafluoroethylene and perfluoroalkylvinylether), PTFE (polytetrafluoroethylene), and a mixture of these. The fluorocarbon resin coats the conductive core bar 61 as a surface insulating layer 63. Specifically, the surface insulating layer 63 is formed on a intermediate layer 62.

In addition to the above, the following can be used as the surface insulating layer 63 in terms of heat resistance and releasability: fluorocarbon resin, such as a copolymer of tetrafluoroethylene and hexafluoropropylene (FEP), a copolymer of ethylene and tetrafluoroethylene (ETFE), polychlorotrifluoroethylene (PCTFE), a copolymer of ethylene and chlorotrifluoroethylene (ECTFE), and polyvinylidene fluoride (PVDF); a material containing fluororubber latex; or a combination of two or more of the above. Using these, the surface insulating layer 63 can be formed by application and firing or by coating the tube.

The intermediate layer 62 improves the adhesive property between the fluorocarbon resin as the surface insulating layer 63 and the surface of the carbon steel tube which is subjected to the parkerizing treatment. The present embodiment uses an insulating primer, such as a rubber-based adhesive agent or a resin-based adhesive agent.

In addition, a heat-resistant endothermic layer is formed on an inner surface of the fixing roller 31. The heat-resistant endothermic layer efficiently absorbs a radiant energy, such as infrared light, discharged from a halogen lamp 64 to an inner periphery surface of the fixing roller 31. Then, the heat-resistant endothermic layer converts the radiant energy into heat. Note that the halogen lamp 64 is a heating element contained in the fixing roller 31 The heat-resistant endothermic layer is formed by, for example, applying and then drying a mixture of a denatured silicone resin, an inorganic heat-resistant black pigment, hydrocarbon (solvent), etc. The heat-resistant endothermic layer has a thickness of 20 μm to 30 μm. Generally, heat-resisting paint, such as Okitsumo (product name), Tetzsol (product name), and Thermo Black (product name), is used. The present embodiment uses Okitsumo.

Note that reference numeral 66 is a thermistor that is a temperature detecting element which detects the surface temperature of the fixing roller 31, reference numeral 65 is a thermostat as means for preventing the temperature from increasing excessively, reference numeral 67 is an upper peeling nail which mechanically peels off a printing medium 91 sticking to the fixing roller 31, and reference numeral 78 is a lower peeling nail which mechanically peels off the printing medium 91 sticking to the pressure roller 32.

The pressure roller 32 is manufactured in such a manner that (i) an insulating elastic layer 72 which is made of silicone rubber, or the like and has heat resistance is formed on the conductive core bar 71 made of iron, stainless steel, or the like, (ii) an intermediate layer 73 is formed on the insulating elastic layer 72, and then (iii) a surface resistive layer 74 which improves the releasability of the surface of the pressure roller 32 is formed on the intermediate layer 73. The intermediate layer 73 improves the adhesive property between the insulating elastic layer 72 and the surface resistive layer 74. In view of the adhesion with respect to the insulating elastic layer 72, an insulating primer is used as the intermediate layer 73 in the present embodiment.

The surface resistive layer 74 of the pressure roller 32 has a surface resistivity of $10^{10}\Omega$. It is possible to use the surface resistive layer 74 having the surface resistivity of $10^{5}\Omega$, however it is preferable that the surface resistive layer 74 have the surface resistivity of $10^{7}\Omega$ to $10^{18}\ \Omega$ or higher. Moreover, it is preferable that the surface resistive layer 74 have a volume resistivity of $10^{7}\ \Omega\cdot$cm or higher. It is more preferable that the surface resistive layer 74 have the volume resistivity of $10^{10}\ \Omega\cdot$cm or higher.

The insulating elastic layer 72 is made of, for example, the silicone rubber (for example, high-temperature vulcanized silicone rubber (HTV), addition reaction hardened silicone rubber (LTV), and condensation reaction hardened silicone rubber (RTV)), fluororubber, or a mixture of these. Specifically, the insulating elastic layer 72 can be formed by, for example, (i) silicone rubber, such as dimethyl silicone rubber, fluorosilicone rubber, methylphenyl silicone rubber, and vinyl silicone rubber, or (ii) fluororubber, such as polyvinylidene rubber, tetrafluoroethylene propylene rubber, tetrafluoroethylene perfluoromethylvinylether rubber, phosphazene fluororubber, and fluoropolyether. These rubber can be used alone or by combining two or more of those, and are molded by cast molding, vulcanization, polishing, etc.

Figure 4:
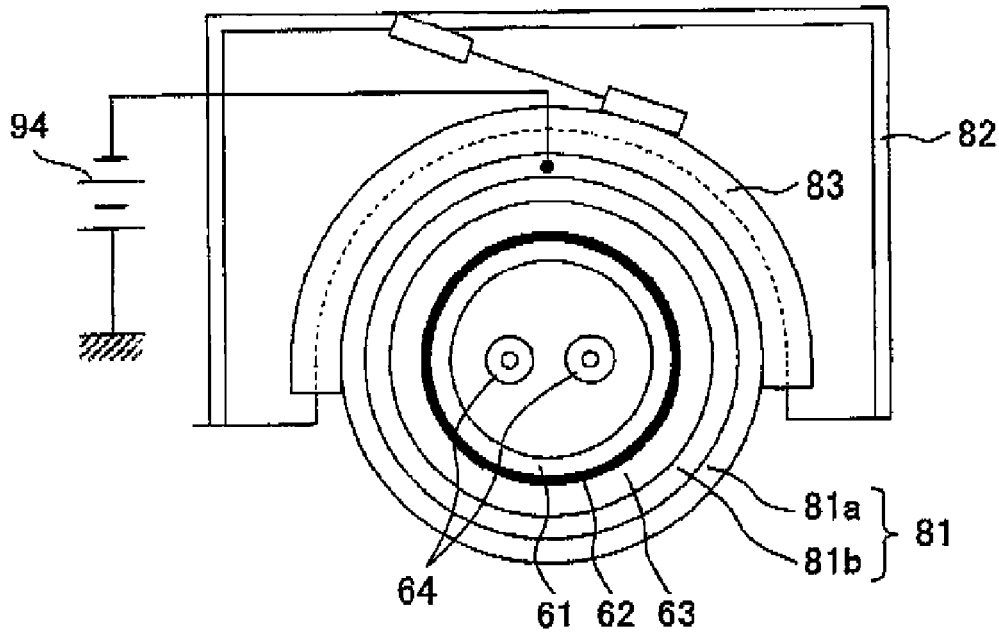
FIG. 4 is a front view showing a support structure of a fixing roller shown in FIG. 1.
Figure 5:
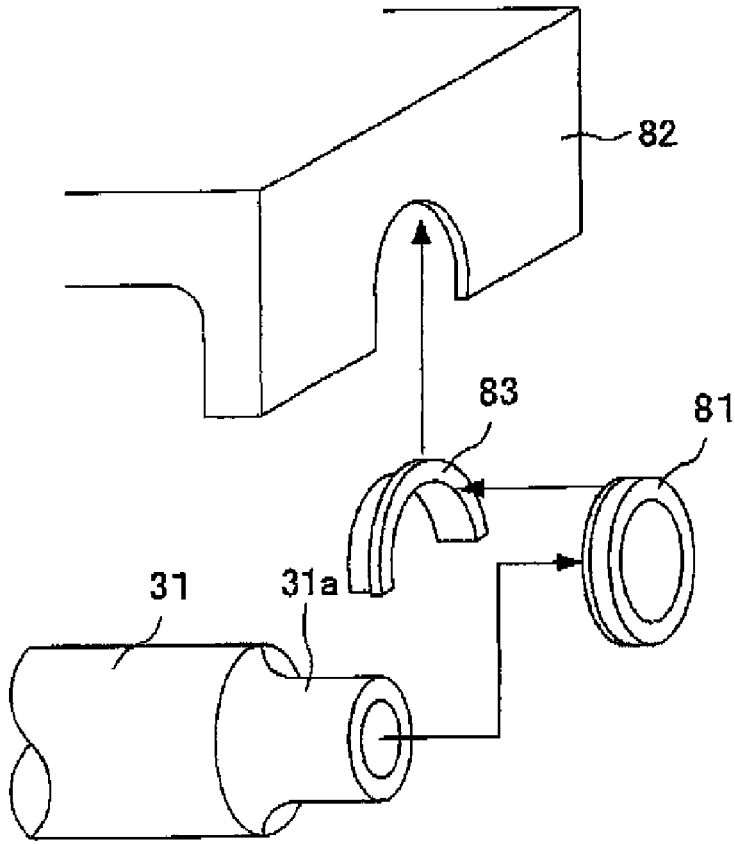
FIG. 5 is an exploded perspective view showing the support structure of the fixing roller shown in FIG. 1.

FIG. 4 is a front view showing a support structure of the fixing roller 31. FIG. 5 is an exploded perspective view showing the support structure of the fixing roller 31. As shown in FIGS. 4 and 5, the fixing roller 31 is supported by a ball bearing 81 attached to a frame 82 of the fixing device 14. The frame 82 is obtained by press molding an iron-based cold rolling steel. The ball bearing 81 includes an outer ring portion 81*a*, a rolling element (not shown), and an inner ring portion 81*b*. Moreover, the ball bearing 81 fits a journal portion 31*a* that is one of thin portions of both end portions of the fixing roller 31.

Meanwhile, in the pressure roller 32, (i) a ball bearing fits a shaft made of, for example, stainless steel, (ii) the ball bearing is received by a load lever which extends from a fulcrum shaft connected to the frame, and (iii) load is applied by, for example, a load spring in a direction of a central axis of the fixing roller 31. A pressure force by this load is 764 N (total of loads applied to both end portions) in the present embodiment, however the pressure force can be set arbitrarily in accordance with the type of the printing medium 91, the stiffness of the fixing roller 31, the stiffness of the pressure roller 32, the adjustment temperature, etc.

The fixing roller 31 and the pressure roller 32 are in contact with each other at a predetermined load. While the fixing roller 31 and the pressure roller 32 sandwich and feed the printing medium 91, the fixing roller 31 and the pressure roller 32 heat and melt an unfixed image formed with a toner, so as to fix the unfixed image on the printing medium 91.

Note that the materials, the sizes, the shapes, etc. used in the present embodiment are not especially limited, but can be changed accordingly as long as a desired performance can be obtained, so that various materials, sizes, and shapes can be used.

Further, in the fixing device 14 of the present embodiment, the pressure roller 32 is in contact with the first cleaning roller 75 that is the cleaning member, the second cleaning roller 76 that is also the cleaning member, and a heating roller 77 that is a second heating member. Note that reference numeral 79 is a thermistor that is a temperature detecting element which detects the surface temperature of the heating roller 77.

Figure 13A:
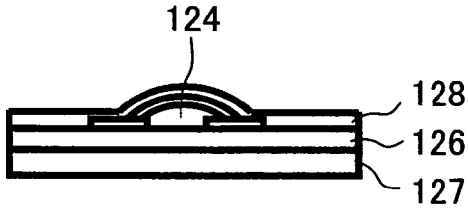
FIG. 13(*a*) is a front view showing a thermistor of an embodiment of the present invention.
Figure 13B:
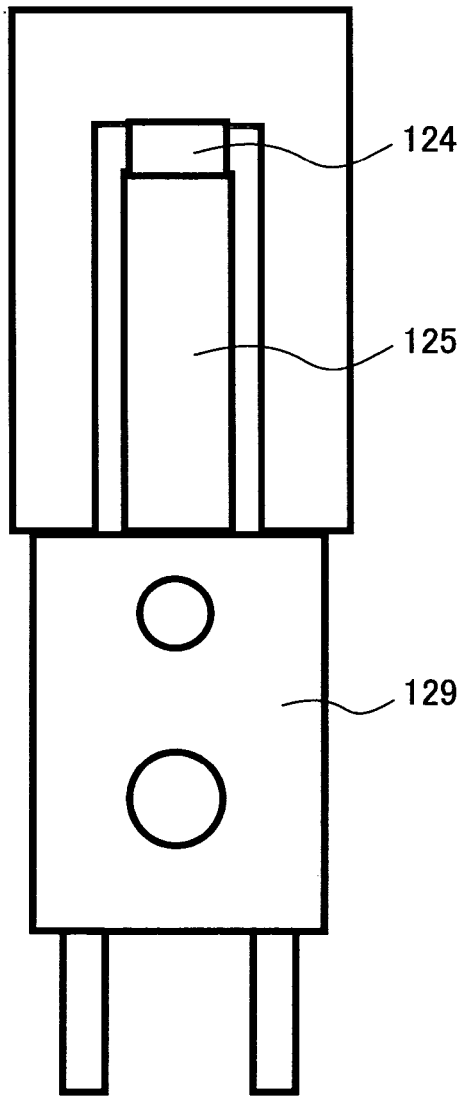

As shown in FIGS. 13(*a*) and 13(*b*), thermal responsiveness of the thermistor used in the present embodiment is improved by directly bonding a thermistor chip 124 on a stainless steel plate 125 which is an elastic member fixed to and supported by a housing 129. Since the thermistor applies a bias voltage and is in contact with the fixing roller 31, the pressure roller 32, and the heating roller 77 each of which has a high potential due to frictional electrification, it is necessary to protect from the high voltage electric systems, such as a temperature control device and the image forming apparatus. Especially, since the stainless steel plate and the above-described respective rollers are close to each other, it is necessary to adequately secure a dielectric strength with respect to a secondary circuit of the temperature control device.

Here, according to the thermistor in the present embodiment, an insulating film layer 126 is formed on a heat-receiving surface of the stainless steel plate 125 on which the thermistor chip 124 is bonded, and a heat-resistant release layer 127 is formed on the insulating film layer 126. Moreover, a protective layer 128 is formed on a surface opposite to the heat-receiving surface. Moreover, to secure an insulation distance between the stainless plate 125 and the surface of the roller, the stainless steel plate 125 is covered by the insulating film layer 126, the heat-resistant release layer 127, and the protective layer 128. Note that the insulating film layer 126, the heat-resistant release layer 127, and the protective layer 128 exists close to the housing 129. With this, a leak current from the rollers do not flow to the thermistor chip 124 or the stainless steel plate 125. On this account, troubles, such as a damage, deterioration, etc. caused by the high voltage, do not occur. As a result, the thermistor can apply a stable bias voltage, and can obtain accurate temperature information. Therefore, it is possible to carry out satisfactory temperature control.

In the present embodiment, the insulating film layer 126 is polyimide (Kapton (product name)) containing adhesive agent and having a thickness of 50 μm, and the heat-resistant layer 127 is formed by impregnating a glass fiber, containing adhesive agent and having a thickness of 130 μm, with heat-resistant release resin. Moreover, the protective layer 128 is Teflon (registered trademark) containing adhesive agent and having a thickness of 80 μm. Note that the materials of these layers are not limited to these, and the other materials can be used as long as a desired performance can be obtained.

The first cleaning roller 75 and the second cleaning roller 76 are made of aluminum, iron, or an alloy of these (including stainless steel). Each roller is formed by (i) processing a hollow roller or a solid roller and (ii) fitting a slide bearing or a rolling bearing to both end portions of the roller. The first cleaning roller 75 and the second cleaning roller 76 are in contact with the pressure roller 32 by, for example, a load spring, while maintaining a nip within a predetermined range with respect to the pressure roller 32. The present embodiment uses cleaning rollers which are made of carbon steel or stainless steel. One of the cleaning rollers has an external diameter of 15 mm (second cleaning roller 76), and another has an external diameter of 8 mm (first cleaning roller 75). The surfaces of the first cleaning roller 75 and the second cleaning roller 76 have a predetermined surface roughness for removing the toner remaining a little on the surface of the pressure roller 32.

Meanwhile, the heating roller 77 is a hollow roller using aluminum, iron, or an alloy of these (including stainless steel). The heating roller 77 heats the surface of the pressure roller 32 by heat conduction at the nip when the heating roller 77 contacts the pressure roller 32, while the heating roller maintains the releasability by a surface release layer 77*a* provided as an outermost surface of the heating roller 77. In the present embodiment, the heating roller 77 is formed in such a manner that (i) an intermediate layer 77*c* is formed on an outer periphery surface of a straight piping 77*b* which is made of aluminum alloy and has an external diameter of 15 mm and a thickness of 0.85 mm, (ii) the surface release layer 77*a* is formed on the intermediate layer 77*c*, (iii) a heat-resistant endothermic layer is formed on an inner peripheral surface of the straight piping 77*b*, as in the fixing roller 31, and (iv) a halogen lamp 77*d* is contained in the straight piping 77*b*.

The intermediate layer 77*c* and the surface release layer (surface insulating layer) 77*a* in the heating roller 77 may be different from the layers of the fixing roller 31, however the intermediate layer 77*c* and the surface release layer (surface insulating layer) 77*a* are the same as the layers of the fixing roller 31. Moreover, a slide bearing or a rolling bearing are fit to both end portions of the heating roller 77, and the heating roller 77 is in contact with the pressure roller 32 by, for example, a load spring, while maintaining a nip within a predetermined range with respect to the pressure roller 32.

As shown in FIGS. 4 and 5, the ball bearing 81 fit to the fixing roller 31 supports load applied via a bearing holder 83 which is provided between the frame 82 and the ball bearing 81 so that electric insulation is realized therebetween. The bearing holder 83 is made of a heat-resistant and insulating material, such as PPS resin (polyphenylene sulfide) and PPO resin (polyphenylene oxide). By this bearing holder 83, the fixing roller 31 is electrically insulated from a frame of the image forming apparatus and the frame 82 of the fixing device 14.

As shown in FIG. 1, a bias device 94 applies a bias voltage to the fixing roller 31 for the purpose of producing a potential difference in a direction for holding a reverse polarity toner 92 on the printing medium 91, although the reverse polarity toner 92 tends to adhere to the back surface of the printing medium 91. In the present embodiment, the transfer device 5 carries out transfer by using a contact method. The transfer device 5 includes rollers shown in FIG. 2, but may include belts. Note that in FIG. 1, the toner 93 adhering to a surface (a surface facing the fixing roller 31) of the printing medium 91 is a toner which forms an image.

Here, the transfer device 5 is provided upstream of the fixing device 14 in a feeding direction of the printing medium 91. The transfer device 5 carries out a transfer process of copying to the printing medium 91 a toner image that is an electrostatic visible image formed on the photosensitive drum 1 with a toner. Here, the reverse polarity toner 92 adheres to the surface of the and the reverse polarity toner 92 moves from the surface of the transfer device 5 to the back surface of the printing medium 91.

Although the transfer device 5 has a mechanism of removing, for example, the reverse polarity toner, paper slips, etc., however in many cases, the fixing device 5 cannot remove those completely. Then, the remaining reverse polarity toner or paper slips are accumulated on the surface of the transfer device 5. Then, due to a power balance of, for example, an electric or mechanical adhesive force, some of or all of the reverse polarity toner or paper slips adhere to the printing medium 91, and are delivered to the fixing device 14 provided downstream of the transfer device 5.

Normally, the reverse polarity toner 92, the paper slips, etc adhere to the printing medium 91, and are output from the image forming apparatus 41 together with the printing medium 91. However, when a conventional fixing device 14 carries out fixing with respect to a large number of printing mediums 91, depending on conditions of the fixing device 14

(especially, the magnitude and polarity of the electrostatic force generated by the frictional electrification of the fixing roller 31 and/or the pressure roller 32), (i) the reverse polarity toner 92 is removed from the printing medium 91, (ii) the reverse polarity toner 92 adheres to the pressure roller 32, and then adheres to the fixing roller 31, and (iii) as a result, the image failure or the image defect occurs on the surface and back surface of the printing medium 91.

Here, in the present embodiment, a fixing bias voltage having a polarity (for example, negative polarity) opposite to the polarity (for example, positive polarity) of the reverse polarity toner 92 is applied to the conductive core bar 61 of the fixing roller 31 in the fixing device 14.

According to this configuration, the fixing bias voltage applied from the bias device 94 to the core bar 61 of the fixing roller 31 produces the electrostatic force in a direction for causing the reverse polarity toner 92 on the back surface of the printing medium 91 to stay there. With this, the reverse polarity toner 92 on the back surface of the printing medium 91 stays on the printing medium 91, and is not removed and does not adhere to the pressure roller 32. As a result, the reverse polarity toner 92 is fixed on the back surface of the printing medium 91, and is output from the image forming apparatus 41 together with the printing medium 91. Since the amount of the reverse polarity toner 92 on a single printing medium 91 is small, the reverse polarity toner 92 does not adversely affect the fixed image.

The following will further explain the fixing bias voltage applied from the bias device 94.

FIG. 6 is a vertical cross-sectional view showing important members and how the printing medium 91 is sandwiched between the fixing roller 31 and the pressure roller 31 in the fixing device 14.

In the present embodiment, the fixing bias voltage of −1 kV is applied to the core bar 61 of the fixing roller 31. The polarity of the fixing bias voltage is negative since the polarity of the reverse polarity toner 92 is positive. Therefore, the electrostatic force acts between the reverse polarity toner 92 and the core bar 61 of the fixing roller 31. With this, it is possible to cause the reverse polarity toner 92 to stay on the back surface of the printing medium 91.

The magnitude of the fixing bias voltage should be within an appropriate range. That is, if the fixing bias voltage is too low, the electrostatic force for holding the reverse polarity toner 92 on the back surface of-the printing medium 91 does not act adequately, and therefore, the reverse polarity toner 92 moves to the pressure roller 32. Meanwhile, if the fixing bias voltage is too high, the electrostatic force for holding the reverse polarity toner 92 on the back surface of the printing medium 91 acts strongly. However, since the surface insulating layer 63 of the fixing roller 31 is thin, the withstand voltage becomes low, and this causes dielectric breakdown. Therefore, it is preferable that the fixing bias voltage be substantially in a range from −100 V to 2 kV (if the polarity of the reverse polarity toner 92 is negative, it is preferable that the fixing bias voltage be substantially in a range form +200 V to 2 kV), although the range of the magnitude of the fixing bias voltage depends on the materials, electric characteristics, film thickness, presence or absence of material defects (pinholes, flaws, etc.), layer structures, etc. of the surface insulating layer 63 and intermediate layer 62 of the fixing roller 31. Note that depending on the configurations of the rollers, the condition of electrification of the toner, the condition of electrification of the rollers, etc., the same effect can be obtained by a zero potential (ground) or floating.

FIG. 7 shows results regarding a relation between the fixing bias voltage and the degree of the image failure on the printing medium 91, in the fixing device 14 of the present embodiment. According to the results shown in FIG. 7, the performance of preventing the image failure is high when the fixing bias voltage is high or when the surface resistivity of the surface insulating layer 63 of the fixing roller 31 is high. Especially, in a high-speed apparatus whose speed of feeding the printing medium is high and whose processing speed is high (for example, the processing speed of 395 mm/s and the copying speed of 70 sheets per minute), the surface resistivity is increased (for example, $10^{14}$ Ω or higher, or more preferably $10^{15}$ Ω or higher). With this, by keeping the timer for maintaining the electric charge on the surface of the fixing roller 31 for, for example, 0.2 second or longer (preferably, 0.3 second or longer) and by keeping a long time for allowing the electric charge to leak and decay, it is possible to cause the reverse polarity toner 92 to effectively stay on the printing medium 91. Note that the upper limit of the time for maintaining the electric charge on the surface of the fixing roller 31 is preferably 1 second or shorter.

The foregoing description also shows that a high current by the fixing bias supplied from the bias device 94 also causes troubles. Therefore, it is desirable that the fixing device 31 have the surface resistivity which can maintain stable current supply. Especially, if the flowing current is too high, the amount of leak current leaking to members which does not require the current increases. This causes other troubles by noises, etc. with respect to a processing system and a control system, such as the image processing system and the image forming process. The surface resistivity for stabilizing the current flowing in the fixing roller 31 can be obtained by defining the volume resistivity of the surface insulating layer 63 and by optimizing the state of the surface (the surface roughness, the amount of liquid adhering to the surface, the environmental condition, etc.) of the fixing roller 31. On this account, it is preferable that the volume resistivity of the surface insulating layer 63 be in a range higher than $10^{13}$ Ω·cm, and it is more preferable that the volume resistivity of the surface insulating layer 63 be higher than $10^{14}$Ω·. If too high current is supplied, a sudden change of current causes adverse influences, such as (i) troubles in operating devices, such as a control device, (ii) deterioration of the surface resistive layer 74 of the pressure roller 32, and (iii) formation of holes.

The function of preventing the occurrence of the image failure by applying the fixing bias voltage from the bias device 94 to the fixing roller 31 can be obtained in a similar manner even if the conductive core bar 61 of the fixing roller 31, the conductive core bar 71 of the pressure roller 32, the intermediate layer 62, the intermediate layer 73, the surface insulating layer 63, and/or the surface resistive layer 74 are replaced with a different type (although the above-described preventing function may change a little). Further, even if the type, thickness, and/or size of the printing medium 91 are changed, the same preventing function can be obtained.

Note that the present embodiment explained a case of using the halogen lamp 64 as the heating element, however, the method of heating the fixing roller 31 can be, for example, (i) an induction heating method for heating the fixing roller 31 by Joule heat, (ii) a resistance heating method for heating the fixing roller 31 by a resistance heating layer formed on the surface or inner surface of the core bar 61, (iii) a flash heating method for heating the fixing roller 31 by irradiation of high energy, such as xenon, and (iv) a pressure fixing method. Even when these various heating methods are used, the above-described preventing function obtained by applying the fixing bias voltage to the fixing roller 31 can be obtained in a similar manner (although the above-described preventing function may change a little). As above, the heating method for the fixing device 14 is not limited to a specific one.

Further, in the present embodiment, the fixing roller 31 contains two halogen lamps 64, and one halogen lamp 64 mainly heats a central portion of the fixing roller 31 and another halogen lamp 64 mainly heats both end portions of the fixing roller 31. However, the portions the halogen lamps 64 heat are not limited to this. For example, one halogen lamp 64 may heat the fixing roller 31 entirely, and another halogen lamp 64 may heat the fixing roller 31 partially. Moreover, the number of the halogen lamps 64 is not limited to two, but may be three or more, or may be one.

Moreover, in addition to the above-described materials for forming the fixing roller 31, the fixing roller 31 can be made of stainless steel, nickel, and an alloy of these, that is, the fixing roller 31 can be made of any material as long as the material satisfy conditions (heat resistance, mechanical strength, etc.) for forming the fixing device 31. Moreover, both end portions of the fixing device 31 may be subjected to the reducing treatment.

As described above, the configuration of the present embodiment is especially effective in a fixing device which carries out transfer by the contact of the belts or the rollers, that is, which uses the contact transfer method.

The material of the bearing holder 83 shown in FIGS. 4 and 5 may be a material having thermal plasticity, such as (i) a PPS-based (polyphenylene sulfide) material, (ii) polyacetal, (iii) polypropylene, (iv) polyamide, (v) polycarbonate, (vi) polyethylene terephthalate, (vii) polyvinyl chloride family, (viii) polytetrafluoroethylene, (ix) a plastic alloy obtained by mixing a few of the above (ii) to (viii), and (x) a composite material obtained by mixing glass fiber, nonmetal filler, or the like with one of or a few of the above (ii) to (viii). Any material having the thermal plasticity can be used as long as the material is made of a solid chain polymer, becomes deformed quickly by heating to a predetermined temperature or higher, has electric insulation, and becomes deformed by heating to 230° C. to 270° C. or higher when the temperature is increased excessively.

When the halogen lamp 64 is continuously turned on because of some kind of abnormality under such state that (i) the bearing holder 83 insulates the ball bearing 81 (the fixing roller 31) and the frame 82 and (ii) the fixing bias voltage is applied, normally, the thermistor detects that the surface temperature of the fixing roller 31 is not within a temperature control range, and the control device turns off a switching element, such as a triac. However, if the halogen lamp 64 is continuously turned on because this switching element is short-circuited, the control device cannot cut off the power distribution. Also, if hardware of the control device is broken or software runs out of control, the control device cannot cut off the power distribution in some cases.

In these cases, the temperature control is not properly carried out, and abnormal overheat of the fixing device and the image forming apparatus 41 occurs and further malfunction occurs by this abnormal overheat. Especially, if the thermal capacity of the fixing roller 31 is reduced by adopting a thin structure for the purpose of shortening a warm-up time in compliance with a demand for saving energy in recent years, the heating rate is high, and the time to reach the abnormal overheat and malfunction is short in many cases.

For example, if (i) there is a big difference between a high heating rate and a low heating rate due to a heat-distribution property of the halogen lamp 64 (for example, a portion to be heated is sectionalized finely by local heating, etc.) and a usage of a super power halogen lamp, and (ii) the positioning of the thermostat 65 is restricted, the operations of the thermostat 65 changes extremely. In this case, the thermostat 65 does not operate properly, or even if the thermostat 65 operates, the thermostat 65 requires a long time.

Here, in the fixing device 14 of the present embodiment, the bearing holder 83 is made of a thermoplastic material, and the thermostat 65 is provided on, for example, the frame 82. Therefore, when the abnormal overheat occurs, the bearing holder 83 receives the heat of the abnormal overheat, and also receives pressure load of the fixing roller 31 and the pressure roller 32. On this account, the bearing holder 83 becomes deformed and is melted, and the gap provided between the thermostat 65 and the fixing roller 31 becomes narrow. As a result, the thermostat 65 easily reacts to an excessive temperature rise of the fixing roller 31, and operates quickly.

Then, the control device detects only the cut-off of the power distribution by the thermostat 65 or detects the cut-off of the power distribution by the thermostat 65 and the abnormality of the fixing bias voltage. With this, the control device can find out the excessive temperature rise of the fixing device 14.

As compared with a conventional configuration, the above-described configuration can operate to handle the abnormal overheat quickly and surely, prevent major malfunction caused due to the abnormal overheat of the fixing device 14 and the image forming apparatus 41, and increase the reliability of the apparatus.

Embodiment 2

The following will explain another embodiment of the present invention in reference to the figures. For ease of explanation, the same reference numerals are used for the members having the same functions as the members used in the above-described embodiment, and further explanations thereof are omitted.

Figure 8:
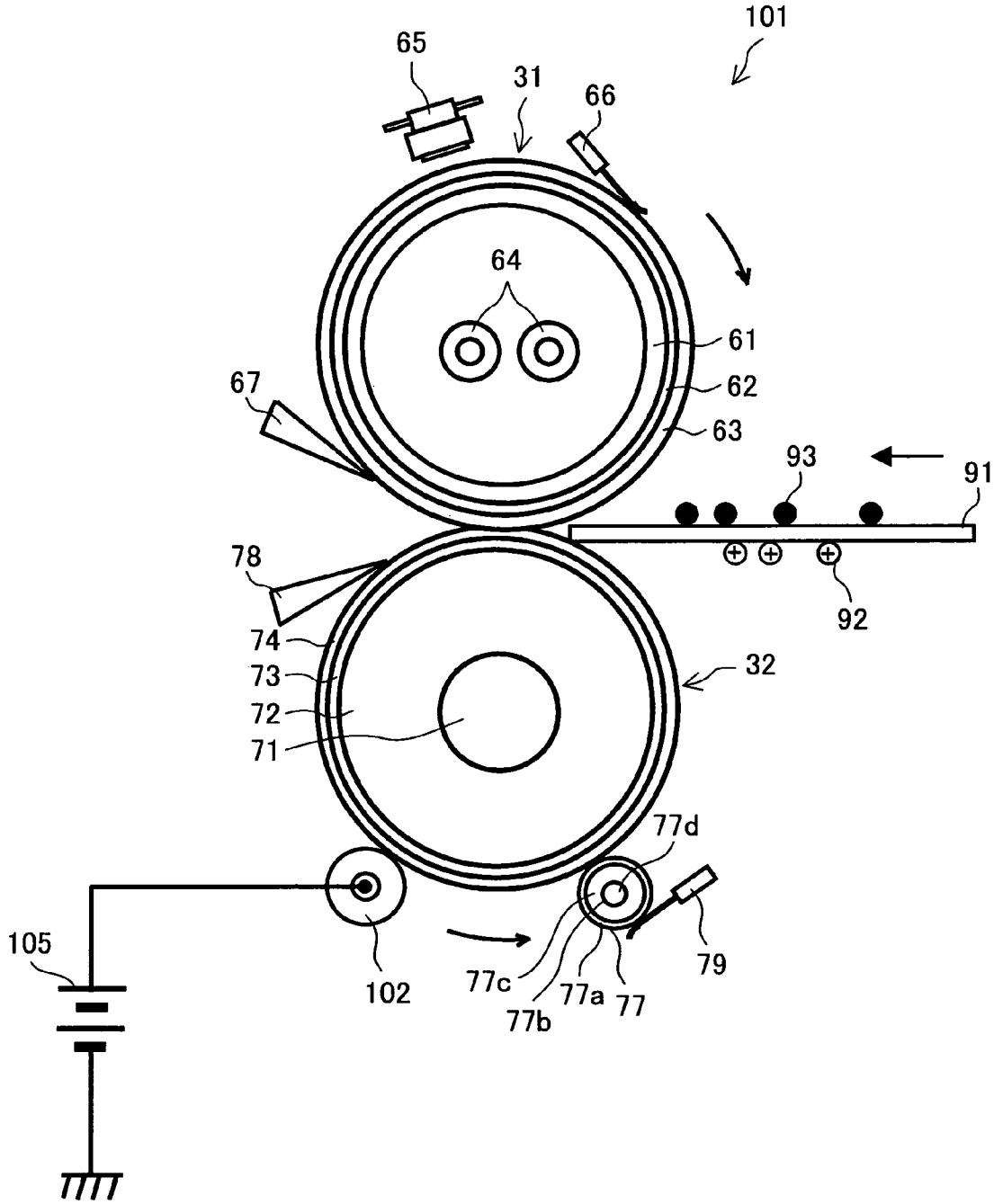
FIG. 8 is a vertical cross-sectional view schematically showing a fixing device of another embodiment of the present invention.

A fixing device 101 of the present embodiment is shown in FIG. 8. The fixing roller 31 is manufactured in such a manner that (i) the intermediate layer 62 is formed on a conductive core bar 61 which has an external diameter of 40 mm and is a linear shape, and then (ii) the surface insulating layer 63 is formed on the intermediate layer 62. The pressure roller 32 is manufactured in the same way as Embodiment 1, except that the external diameter is 35 mm.

The fixing device 101 carries out fixing by using, for example, the halogen lamp. Two halogen lamps 64 are contained in the fixing roller 31 (one for heating the central portion of the fixing roller 31, and another for heating both end portions of the fixing roller 31), and one halogen lamp **77*d* (for heating the heating roller 77 entirely) is contained in the heating roller 77**.

The heating roller 77 is in contact with the surface of the pressure roller 32, and a cleaning roller 102 is also in contact with the surface of the pressure roller 32. The cleaning roller 102 is provided upstream of the heating roller 77 in a rotation direction of the pressure roller 32.

The image forming apparatus 41 including the fixing device 101 has a processing speed of, for example, 335 mm/s and a copying speed (printing speed) of 55 sheets per minute to 65 sheets per minute. In the image forming apparatus 41, the transfer device 5 includes belts.

The cleaning roller 102 has the same configuration as the cleaning rollers 75 and 76, and is conductive. To the cleaning roller 102, the fixing bias voltage is applied from a bias device 105. The fixing bias voltage applied from the fixing device 101 is to give the electrostatic force in a direction for holding the reverse polarity toner 92 on the back surface of the printing medium 91. Note that this reverse polarity toner 92 has, for example, the positive polarity and adheres to the back surface of the printing medium 91. The fixing bias voltage has the same polarity as the reverse polarity toner 92, and is +1 kV in the present embodiment.

The fixing bias voltage is applied through the cleaning roller 102 to the surface of the pressure roller 32, so that the surface of the pressure roller 32 is positively electrified. With this, the reverse polarity toner 92 on the back surface of the printing medium 91 stays on the back surface of the printing medium 91, and does not move to the pressure roller 32. As a result, the reverse polarity toner 92, the amount of which is very small, on the back surface of the printing medium 91 is fixed on the printing medium 91, and is output from the image forming apparatus 41 together with the printing medium 91.

FIG. 9 shows results regarding a relation between the fixing bias voltage and the degree of an image failure on the printing medium 91, in the fixing device 101 of the present embodiment. According to the results shown in FIG. 9, the performance of preventing the image failure is high when the surface resistivity of a surface resistive layer 74 of the pressure roller 32 is high or when the fixing bias voltage is high. In this case, it is effective to apply the fixing bias voltage corresponding to the surface resistive layer 74 of the pressure roller 32.

Meanwhile, if the fixing bias voltage and/or the surface resistivity of the surface resistive layer 74 are too low, the electric charge maintained on the surface of the pressure roller 32 cannot be maintained on the surface of the pressure roller 32 for a time required for causing the electric charge to act as the surface potential of the pressure roller 32. Therefore, the effect of causing the reverse polarity toner 92 to stay on the printing medium 91 reduces quickly. That is, if the surface resistivity of the surface resistive layer 74 is low and the decay time is short (for example, shorter than 0.2 second), the effect of causing the reverse polarity toner 92 to stay on the printing medium 91 cannot be obtained adequately.

The above-described effect cannot be obtained because, before a nip portion to which the fixing bias voltage from the cleaning roller 102 is applied and where the cleaning roller 102 is in contact with the pressure roller 32 reaches a nip portion where the pressure roller 32 is in contact with the fixing roller 31, the potential of this nip portion lowers. Therefore, the electrostatic force generated by the potential of the nip portion cannot cause the reverse polarity toner 92 to stay on the printing medium 91 adequately. As a result, the reverse polarity toner 92 moves to the surface of the pressure roller 32, and some of the reverse polarity toner 92 is collected by the cleaning roller 102, however the remaining reverse polarity toner 92 remains on the surface of the heating roller 77 or the surface of the pressure roller 32. Eventually, the remaining reverse polarity toner 92 adheres to the back surface of the other printing medium 91 or adheres again to the surface of the fixing roller 31. The reverse polarity toner 92 adhered to the surface of the fixing roller 31 adheres to the surface of the other printing medium 91, and this causes the image defects.

In the fixing device 101 of the present embodiment, the surface resistivity of the surface resistive layer 74 of the pressure roller 32 is increased to, for example, $10^7$ Ω or higher, or more preferably $10^8$ Ω or more. With this, by keeping the time for maintaining the electric charge on the surface of the pressure roller 32 for, for example, 0.2 second or longer (preferably, 0.3 second or longer) and by keeping a long time for allowing the electric charge to leak and decay, it is possible to cause the reverse polarity toner 92 to effectively stay on the printing medium 91.

Similarly, it is preferable that the volume resistivity of the surface resistive layer 74 be $10^5$ Ω·cm or higher, and it is more preferable that the volume resistivity of the surface resistive layer 74 be $10^{10}$ Ω·cm or higher. With this, the same effect can be obtained.

The function of preventing the occurrence of the image failure by applying the fixing bias voltage from the bias device 105 can be obtained in a similar manner even if the conductive core bar 61 of the fixing roller 31, the conductive core bar 71 of the pressure roller 32, the intermediate layer 62, the intermediate layer 73, the surface insulating layer 63, and/or the surface resistive layer 74 are replaced with a different type (although the above-described preventing function may change a little). Further, even if the type, thickness, and/or size of the printing medium 91 are changed, the same preventing function can be obtained.

Figure 10:
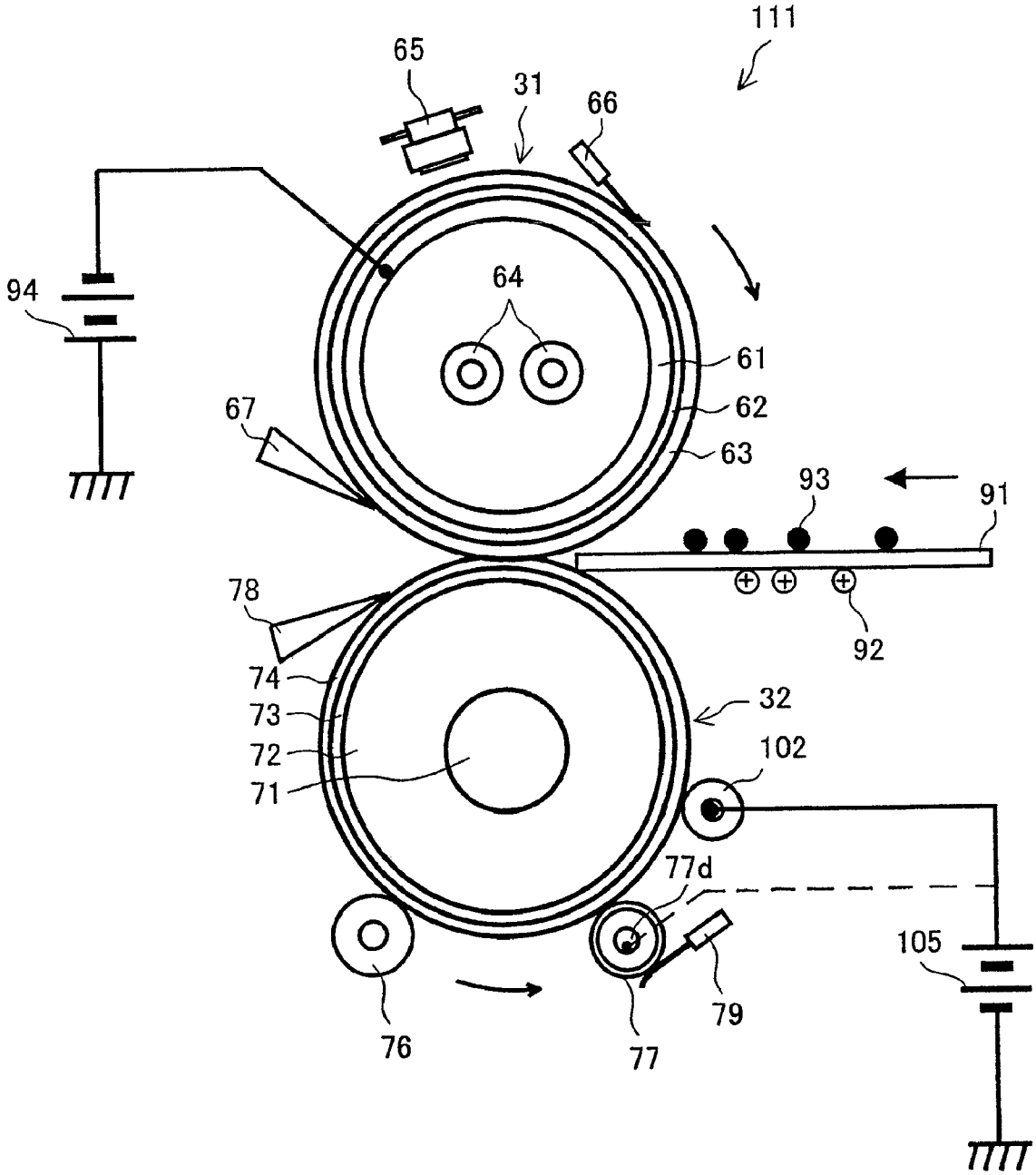
FIG. 10 is a vertical cross-sectional view schematically showing a fixing device of yet another embodiment of the present invention.

The above-described fixing device 101 is configured so that the fixing bias voltage is applied from the bias device 105 to the pressure roller 32 for the purpose of causing the reverse polarity toner 92 to stay on the printing medium 91. As an improved version of this configuration, the configuration shown in FIG. 10 can be used. A fixing device 111 shown in FIG. 10 is configured such that the bias device 105 applies the fixing bias voltage through the cleaning roller 102 to the surface of the pressure roller 32 and the bias device 94 applies the fixing bias voltage to the conductive core bar 61 of the fixing roller 31.

That is, a first fixing bias voltage is applied to the core bar 61 of the fixing roller 31, and a second fixing bias voltage is applied to the cleaning roller 102 which is in contact with the surface of the pressure roller 32 and is a first cleaning roller. Note that the first fixing bias voltage is a voltage having a polarity opposite to that of the reverse polarity toner 92 on the printing medium 91, and the second fixing bias voltage is a voltage having the same polarity as the reverse polarity toner 92. In the present embodiment, the first fixing bias voltage is, for example, −1 kV, and the second fixing bias voltage is, for example, +800 V.

In the fixing device 111, the second cleaning roller 76 is provided upstream of the heating roller 77 in a rotation direction of the pressure roller 32, and the cleaning roller 102 that is the first cleaning roller is provided downstream of the heating roller 77.

Moreover, the second fixing bias voltage may be applied to the heating roller 77, not the cleaning roller 102. In this case, the second fixing bias voltage is, for example, +1 kV.

The fixing device 111 has both the function (of the fixing device 101) of causing the reverse polarity toner 92 to stay on the printing medium 91 by applying the second fixing bias voltage to the pressure roller 32 and the function (of the fixing device 14) of causing the reverse polarity toner 92 to stay on the printing medium 91 by applying the first fixing bias voltage to the fixing roller 31. Therefore, the fixing device 111 can surely cause the reverse polarity toner 92 to stay on the printing medium 91, without causing the reverse polarity toner 92 to move from the printing medium 91 to the surface of the pressure roller 32.

That is, in the fixing device 111, the electrostatic force for holding the reverse polarity toner 92 on the printing medium 91 acts with respect to the reverse polarity toner 92 of the printing medium 92 from both the fixing roller 31 and the pressure roller 32. Therefore, the function of causing the reverse polarity toner 92 to stay on the printing medium 91 acts more strongly.

Here, a current flowing to the fixing roller 31 by the first fixing bias voltage is usually about 10 μA or less. Moreover, even when the current flows to the fixing roller 31 through the printing medium 91 which is passing through the fixing device 111, the current is usually about 20 μA to 40 μA.

However, depending on conditions, such as the surface resistivity and the volume resistivity of the fixing roller 31, the pressure roller 32, etc., and the configurations of the rollers, the current may be more than 150 μA. In this case, if an excessive current flows through a route of (i) the fixing roller 31, the pressure roller 32, and the frame of the image forming apparatus 41, (ii) the fixing roller 31, the printing medium 91, and the frame of the image forming apparatus 41, or (iii) the cleaning roller 102, the pressure roller 32, the printing medium 91, and the frame of the image forming apparatus 41, the noise, etc. contaminates the control device and image processing device of the image forming apparatus 41, and this causes malfunction. Therefore, the current flown as the fixing bias voltage needs to be within a predetermined low range. Moreover, the current flown may cause troubles, such as deterioration or formation of holes of the surface resistive layer 74 of the pressure roller 32.

As described above, the configuration of the present embodiment is especially effective in a fixing device which uses the contact transfer method, that is, which carries out transfer by the contact of the belts or the rollers.

Embodiment 3

The following will explain yet another embodiment of the present invention in reference to the figures. For ease of explanation, the same reference numerals are used for the members having the same function as the members used in the above-described embodiments, and further explanations thereof are omitted.

Figure 11:
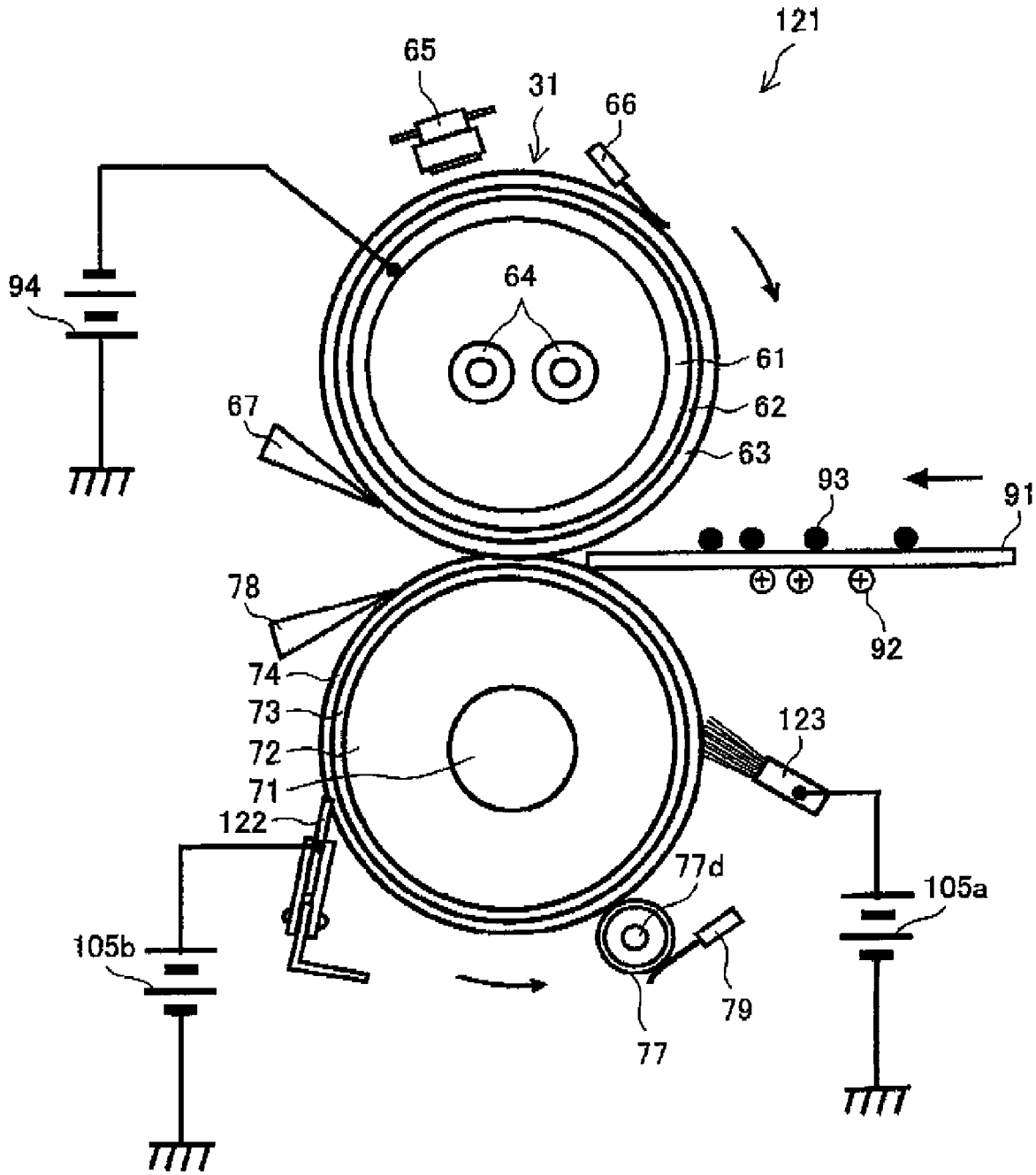
FIG. 11 is a vertical cross-sectional view schematically showing a fixing device of still another embodiment of the present invention.

A fixing device 121 of the present embodiment is shown in FIG. 11. The fixing bias voltage having a polarity opposite to that of the reverse polarity toner 92 is applied from the bias device 94 to the conductive core bar 61 of the fixing roller 31. For the pressure roller 32, a scraper 122 made of, for example, conductive SUS (stainless steel) is provided at a position close to a position where the printing medium is output near an outer periphery portion of the pressure roller 32, and a potential given brush 123 is provided at a position close to a position where the printing medium is input. The fixing bias voltage having the same polarity as the reverse polarity toner 92 is applied from a bias device 105*b* to the scraper 122, and the fixing bias voltage having the same polarity as the reverse polarity toner 92 is applied from a bias device 105*a* to the potential given brush 123. In the present embodiment, the fixing bias voltage from the bias device 94 is −1 kV, the fixing bias voltage from the bias device 105*b* is +600 V, and the fixing bias voltage from the bias device 105*a* is +1,000 V.

In addition to the conductive SUS, the material of the scraper 122 may be, for example, (i) heat-resistant resin, such as PI (polyimide), PFA (copolymer of tetrafluoroethylene and perfluoroalkylvinylether), and PC (polycarbonate), on the surface of which a conduction coating is formed or the surface of which is subjected to a surface modification so that the heat-resistant resin become conductive, or (ii) the heat-resistant resin in which a conductive material, such as conductive powder or conductive fiber (carbon, metal, etc.) filled so that the heat-resistant resin become conductive.

The scraper 122 is a member for cleaning the pressure roller 32. Specifically, the scraper 122 mainly functions as a member for mechanically removing the toner from the surface of the pressure roller 32, and also functions as a member for applying a potential to the pressure roller 32. The scraper 122 is conductive or semiconductive. When the scraper 122 is grounded, or when the fixing bias voltage is applied to the scraper 122, the scraper 122 controls the electric charge maintained on the surface of the pressure roller 32, and produces the electrostatic force in a direction for holding the reverse polarity toner 92 on the printing medium 91. With this, it is possible to prevent the reverse polarity toner 92 from adhering to the pressure roller 32 so that the pressure roller 32 is not contaminated by the reverse polarity toner 92, and it is also possible to extend the life of the pressure roller 32 since the life of the pressure roller 32 depends on whether the pressure roller 32 is contaminated by the reverse polarity toner 92 or not. Moreover, it is possible to simplify the arrangement around the pressure roller 32 by providing the scraper 122.

Moreover, the potential given brush 123 is formed by metal fiber, organic conductive fiber, etc. Examples of the metal fiber are carbon fiber, stainless steel fiber, and amorphous fiber, and examples of the organic conductive fiber are acrylic fiber to which copper binds, PVA fiber to which copper binds and which is subjected to a special metal treatment, fiber obtained by mixing acryl and carbon short fiber, polyester which is subjected to a silver treatment. Like the scraper 122, the potential given brush 123 functions as a member for giving a potential to the pressure roller 32. Therefore, the potential given brush 123 functions as a member for preventing the reverse polarity toner 92 from contaminating the surface of the pressure roller 32, like the scraper 122.

Figure 12:
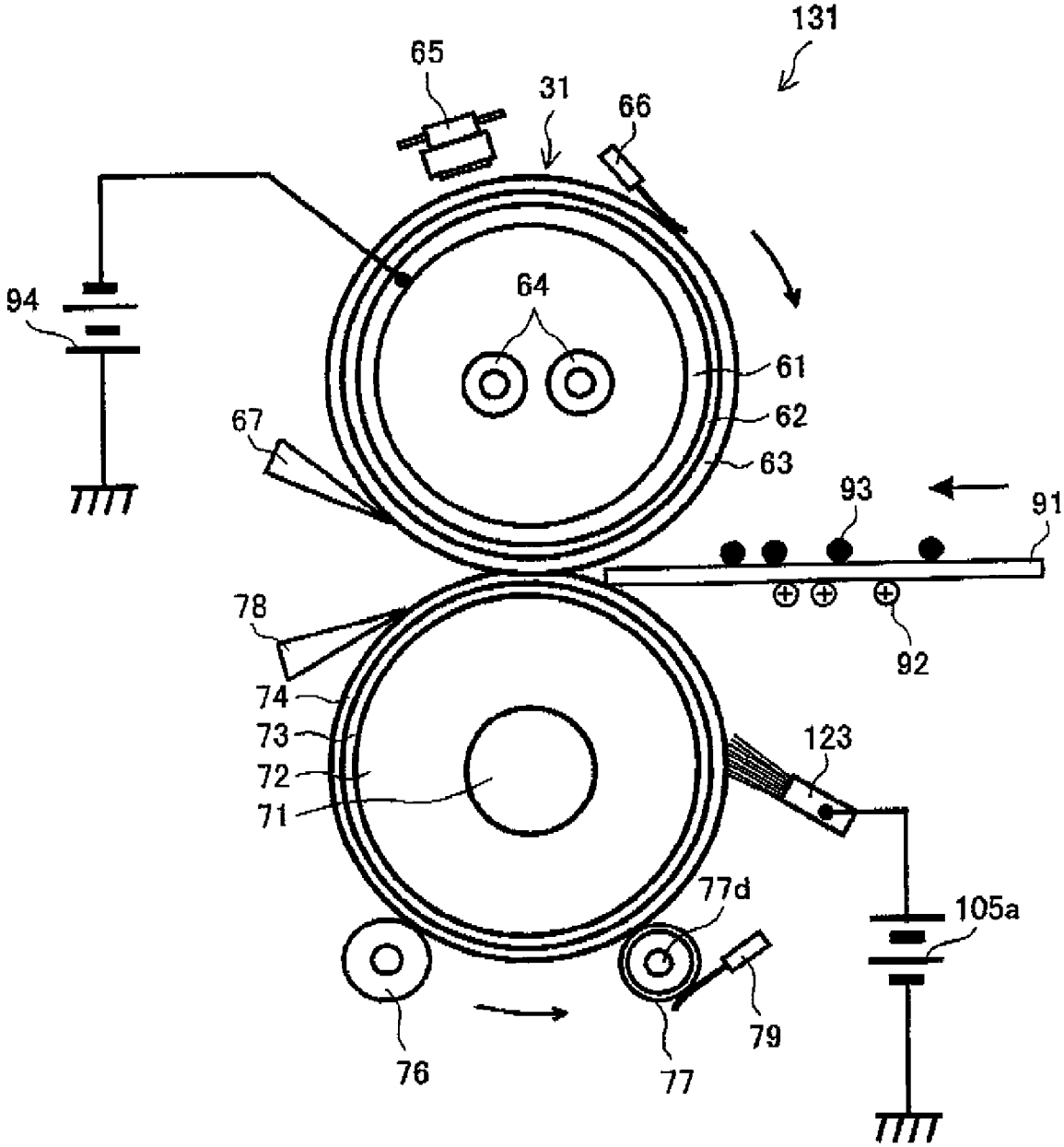
FIG. 12 is a vertical cross-sectional view schematically showing a fixing device of yet another embodiment of the present invention.

Note that in the fixing device 121, the scraper 122 and the potential given brush 123 are provided as members for giving the potential to the pressure roller 32. However, as shown in FIG. 12, only the potential given brush 123 may be provided for the pressure roller 32. Alternatively, only the scraper 122 may be provided for the pressure roller 32. In the present embodiment, the potential given brush 123 is in contact with the pressure roller 32, however the potential given brush 123 may be provided near the pressure roller 32 so as not to be in contact with the pressure roller 32, or the potential given brush 123 may be grounded so that the potential to be applied to the pressure roller 32 is a zero potential.

Moreover, in the above-described embodiments, a timing for applying the bias voltage may be set as follows. That is, the timing can be determined in accordance with (i) the electrostatic capacity of the roller and the magnitude of the bias voltage to be applied, (ii) a property (potential given property) of the roller to which the bias voltage is applied and which reaches a predetermined potential, and an electrification property of the roller which is electrified by friction caused by the rotation of the roller (although these properties depend on the physical property (the surface resistivity, the volume resistivity) of the roller), and (iii) a timing when the printing medium enters the nip portion of a pair of rollers. However, it is highly effective to apply the bias voltage at the same time as or before the start of the rotation of the two rollers. Note that the bias voltage can be applied after the two rollers start rotating as long as the ability of applying the potential is high and the desired potential can be maintained even just before the printing medium enters the nip portion.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention can be utilized as (i) a fixing method and a drying method which are preferably used in a fixing device in an electrophotographic device (copier, printer), a drying device in a wet electrophotographic device, a drying device in an inkjet printer, a deleting device for a rewritable medium, and (ii) a fixing device using the fixing method and a drying device using the drying method. In addition to the use as a heating device and the drying device of an image forming apparatus (copier, printer), the present invention can be utilized in a general printing device as a method and device of sandwiching and feeding a printing medium by a fixing member and a pressure member which are rollers or belts.

The invention claimed is:

1. A fixing device comprising:

a fixing member which is in contact with an unfixed image formed on a printing medium with a developer; and a pressure member which is in contact with the fixing member, the fixing member and the pressure member sandwiching the printing medium so as to feed the printing medium, so that the unfixed image on the printing medium is fixed on the printing medium, the fixing device further comprising holding electric field generating means for generating a holding electric field which is an electric field in a direction for holding a reverse polarity developer on the printing medium, the reverse polarity developer having a polarity opposite to a polarity of the developer which forms an image on the printing medium, wherein said holding electric field generating means includes bias voltage applying means for applying a bias voltage, which generates the holding electric field, to at least one of the fixing member and the pressure member, wherein:

the pressure member includes a conductive core bar, an insulating elastic layer on the conductive core bar, an intermediate layer on the insulating elastic layer, and a surface resistive layer on the intermediate layer;

a potential given member is provided on a surface of the pressure member;

said bias voltage applying means applies the bias voltage to the potential given member; and the bias voltage is applied through the potential given member to a surface of the pressure member or near the surface of the pressure member, wherein:

the fixing member includes first heating means for heating a surface of the fixing member; and the potential given member also functions as a heating member for heating the surface of the pressure member.

* * * * *